US006771148B2

(12) United States Patent
Okamura et al.

(10) Patent No.: US 6,771,148 B2
(45) Date of Patent: Aug. 3, 2004

(54) DUAL MODE BAND-PASS FILTER

(75) Inventors: Hisatake Okamura, Nagaokakyo (JP); Seiji Kanba, Kusatsu (JP); Naoki Mizoguchi, Shiga-ken (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 10/388,530

(22) Filed: Mar. 17, 2003

(65) Prior Publication Data

US 2003/0160667 A1 Aug. 28, 2003

Related U.S. Application Data

(62) Division of application No. 09/782,132, filed on Feb. 13, 2001, now Pat. No. 6,720,848.

(30) Foreign Application Priority Data

Feb. 24, 2000 (JP) ..... 2000-047919

(51) Int. Cl.[7] ..... H01P 1/20
(52) U.S. Cl. ..... 333/204; 333/219
(58) Field of Search ..... 333/204, 219, 333/205, 235

(56) References Cited

U.S. PATENT DOCUMENTS

| | | | | |
|---|---|---|---|---|
| 5,623,238 | A | 4/1997 | Takahashi et al. | 333/204 |
| 6,121,861 | A | 9/2000 | Yabuki et al. | 333/204 |
| 6,201,458 | B1 | 3/2001 | Matsuo et al. | 333/204 |
| 6,218,915 | B1 | 4/2001 | Schallner | 333/219 |

FOREIGN PATENT DOCUMENTS

| | | |
|---|---|---|
| EP | 0 509 636 | 10/1992 |
| EP | 0 571 777 | 12/1993 |
| JP | 5-251904 | 9/1993 |
| JP | 6-112701 | 4/1994 |
| JP | 8-46413 | 2/1996 |
| JP | 9-139612 | 5/1997 |
| JP | 9-162610 | 6/1997 |
| JP | 9-186502 | 7/1997 |

*Primary Examiner*—Stephen E. Jones
(74) *Attorney, Agent, or Firm*—Keating & Bennett, LLP

(57) ABSTRACT

A dual mode band-pass filter includes a metallic film for defining a resonator, disposed on the first main surface of a dielectric substrate having first and second main surfaces, or inside of the dielectric substrate. An opening is formed in the metallic film. At least one ground electrode is provided on the second main surface of the dielectric substrate or inside of the dielectric substrate, so as to be opposed to the metallic film through a dielectric layer. A pair of input-output coupling circuits is connected to the metallic film.

4 Claims, 36 Drawing Sheets

NO OPENING

LENGTH OF OPENING 6mm

LENGTH OF OPENING 8mm

LENGTH OF OPENING 10mm

LENGTH OF OPENING 13.5mm

DUAL MODE BAND-PASS FILTER

This application is a Divisional of U.S. patent application Ser. No. 09/782,132 filed Feb. 13, 2001, now U.S. Pat. No. 6,720,848.

BACKGROUND OF THE INVENTION

1. Field of the Invention

The present invention relates to a dual mode band-pass filter for use in, for example, communications equipment operating in the range of the microwave band to the milli-wave band.

2. Description of the Related Art

Conventionally, different types of dual mode band-pass filters have been proposed as a band-pass filter for use in a high frequency band as described in "MINIATURE DUAL MODE MICROSTRIP FILTERS", J. A. Curtis and S. J. Fiedziuszko, 1991 IEE MTT-S Digest.

FIGS. 48 and 49 are schematic plan views illustrating conventional dual mode band-pass filters, respectively.

In a band-pass filter 200 shown in FIG. 48, a circular conductive film 201 is provided on a dielectric substrate (not shown). Input-output coupling circuits 202 and 203 are coupled to the conductive film 201 so as to define an angle of 90° relative to each other. A tip-open stub 204 is disposed on the conductive film 201 at a position that defines a central angle of 45° relative to the input-output coupling circuit 203. Thereby, two resonance modes with different resonance frequencies are coupled together. Thus, the band-pass filter 200 is configured so as to operate as a dual mode band-pass filter.

In a dual mode band-pass filter 210 shown in FIG. 49, a substantially square conductive film 211 is disposed on a dielectric substrate. Input-output coupling circuits 212 and 213 are connected to the conductive film 211 so as to define an angle of 90° relative to each other. The corner of the conductive film 211 in the position thereof defining an angle of 135° with respect to the input-output coupling circuit 213 is cut away. The resonance frequencies in two resonance modes are made different from each other by the cut portion 211*a*, so that the two resonance modes having different resonance frequencies are coupled to each other. Thus, the band-pass filter 210 can be operated as a dual mode band-pass filter.

On the other hand, there has been proposed a dual mode band-pass filter that contains a ring-shape conductive film instead of the circular conductive film (Japanese Unexamined Patent Application Publication No. 9-139612 and No. 9-162610). In particular, a dual mode filter is disclosed, in which a ring-shaped ring transmission line is used, input-output coupling circuits are arranged so as to define a central angle of about 90° similarly to the dual mode band-pass filter 200 shown in FIG. 48, and a tip-open stub is provided in a portion of the ring transmission line.

Moreover, Japanese Unexamined Patent Application Publication No. 6-112701 discloses a dual mode band-pass filter that uses a ring transmission line similar to the above-mentioned transmission line. As shown in FIG. 50, in the dual mode filter 221, a ring resonator includes a ring conductive film 222 disposed on a dielectric substrate. In this case, four terminals 223 to 226 are disposed on the ring conductive film 222 so as to define an angle of 90° relative to each other with respect to the center of the ring conductive film 222. Two of the four terminals arranged at the positions defining an angle of 90° relative to each other with respect to the center of the ring conductive film are connected to input-output coupling circuits 227 and 228, respectively. The remaining two terminals 225 and 226 are connected to each other via a feedback circuit 230.

Moreover, it is described that in the ring resonator including one strip line and having the above-described configuration, perpendicular resonance modes, which are not coupled to each other, are generated, and the coupling degree is controlled by the above-mentioned feedback circuit 230.

In the conventional dual mode band-pass filters shown in FIGS. 48 and 49, a two step band-pass filter can be formed by forming one conductive film pattern. Accordingly, the band-pass filter can be miniaturized.

However, the dual mode band-pass filters each have the configuration in which the input-output coupling circuits, which are separated from each other by a particular angle, are coupled to each other in the circular or square conductive film pattern. Therefore, the dual mode band-pass filters have the disadvantage that the coupling degree cannot be increased, and a wide pass band cannot be achieved.

In the band-pass filter shown in FIG. 48, the conductive film 201 is restricted to a circular shape. In the band-pass filter shown in FIG. 49, the conductive film 211 is also limited to a substantially square shape. Thus, there is the problem that the design flexibility is low.

Dual mode band-pass filters 221 using such a ring resonator as described in Japanese Unexamined Patent Application Publication Nos. 9-139612 and 9-162610 have the problem that it is difficult to improve the coupling degree, and the shape and size of the ring resonator are restricted.

On the other hand, in the dual mode band-pass filter 221 described in Japanese Unexamined Patent Application Publication No. 6-112701, the coupling degree is controlled, and the band-width can be widened by use of the feedback circuit 230. However, in the conventional dual mode filter, the feedback circuit 230 is required. Thus, the circuit configuration becomes complicated. Furthermore, the shape and size of the ring resonator are limited to a ring-shape, so that the design flexibility is very low.

SUMMARY OF THE INVENTION

In order to overcome the problems described above, preferred embodiments of the present invention provide a dual mode band-pass filter that is miniaturized and has a greatly improved coupling degree that is easily adjusted and a very wide pass band, while also having very high design flexibility.

According to a preferred embodiment of the present invention, a dual mode band-pass filter includes a dielectric substrate having first and second main surfaces, a metallic film having an opening for coupling two resonance modes and disposed in the first main surface of the dielectric substrate or inside of the dielectric substrate, at least one ground electrode disposed on the second main surface of the dielectric substrate or inside of the dielectric substrate, so as to be opposed to the metallic film through a dielectric layer, and a pair of input-output coupling circuits connected to different portions of the metallic film. With the above-described unique configuration, one of the two resonance modes, that is, one propagated substantially parallel to an imaginary straight line passing through the connection points at which the pair of the input-output coupling circuits are connected to the metallic film, and the other propagated substantially perpendicularly to the imaginary line, is affected by the opening so that the resonance frequency is varied. In other words, the opening is arranged to exert an influence over the resonance current of one of the resonance modes whereby the one resonance mode can be coupled to the other resonance mode. Thus, the opening causes the two resonance modes to be coupled to each other, and as a result, the filter can be operated as a dual mode band-pass filter.

Preferably, the opening has a shape containing a longitudinal dimension and a width dimension.

Also preferably, the plan shape of the opening is a rectangle, an ellipse, or a configuration including a rectangle or ellipse having a bent portion thereof elongating in a direction intersecting the longitudinal dimension thereof.

It is also preferred if the plan shape of the opening is a rectangle, a rhombus, a regular polygon, a circle, or an ellipse.

In addition, a plurality of openings may be formed.

Preferably, the metallic film is disposed on the first main surface of the dielectric substrate, and the ground electrode is disposed on the second main surface of the dielectric substrate.

Also preferably, the metallic film is disposed at a vertical level inside of the dielectric substrate, and the ground electrodes are disposed on the first and second main surfaces of the dielectric substrate, whereby the band-pass filter has a tri-plate structure.

For the purpose of illustrating the present invention, there is shown in the drawings several forms that are presently preferred, it being understood, however, that the invention is not limited to the precise arrangements and instrumentalities shown.

Other features, elements, characteristics and advantages of the present invention will become more apparent from the detailed description of preferred embodiments below with reference to the attached drawings.

DETAILED DESCRIPTION OF PREFERRED EMBODIMENTS

Hereinafter, preferred embodiments of the present invention will be described.

Figure 1:
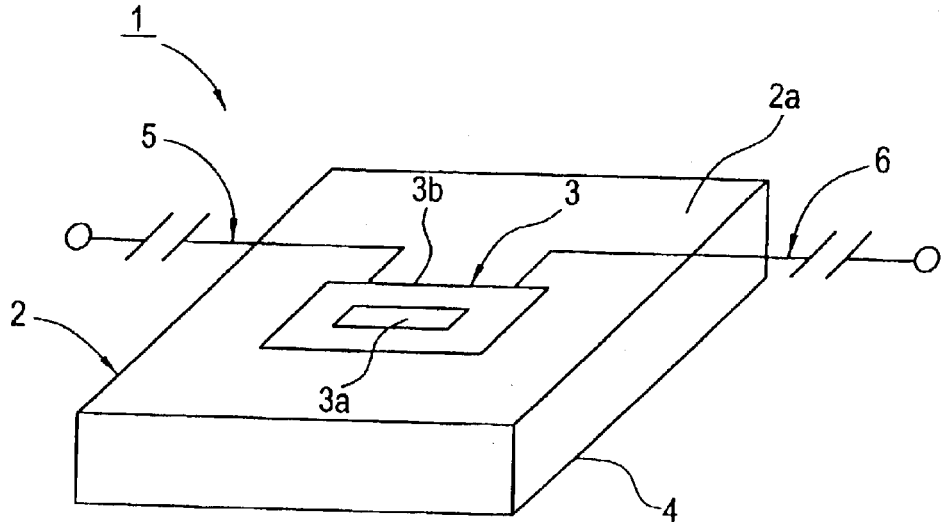
FIG. 1 is a perspective view of a dual mode band-pass filter according to a first preferred embodiment of the present invention.
Figure 2:
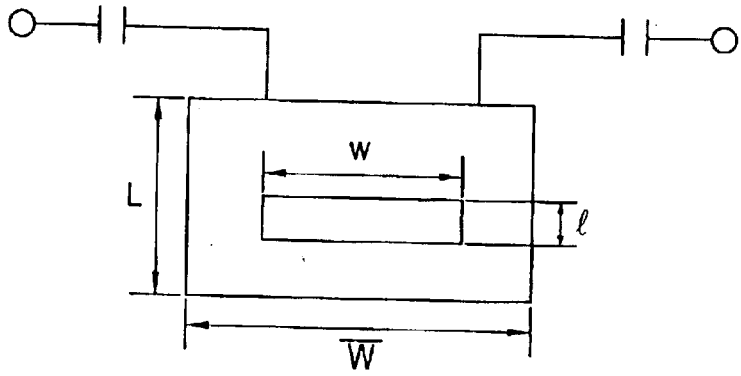
FIG. 2 is a schematic plan view showing the major portion of the dual mode band-pass filter of the first preferred embodiment of the present invention.

FIG. 1 is a perspective view of a dual mode band-pass filter according to a first preferred embodiment of the present invention. FIG. 2 is a schematic plan view of the dual mode band-pass filter according to the first preferred embodiment of the present invention.

A dual mode band-pass filter 1 preferably includes a substantially rectangular sheet dielectric substrate 2. In this preferred embodiment, the dielectric substrate 2 is preferably made of a fluororesin having a dielectric constant $\epsilon r$ of about 2.58. However, in this and below-described preferred embodiments, as dielectric materials for forming the dielectric substrate, appropriate dielectric materials such as BaO—$Al_2O_3$—$SiO_2$ type ceramics or other suitable materials can be used, in addition to the fluororesin described above.

The thickness of the above-described dielectric substrate 2 has no particular limitations. In this preferred embodiment, the thickness is preferably about 350 $\mu$m.

A metallic film 3 is provided on the upper surface 2*a* of the dielectric substrate 2 to define a resonator. The metallic film 3 is formed in a partial area on the dielectric substrate 2, and preferably has a substantially rectangular shape with including longer and shorter sides in this preferred embodiment. An opening 3*a* is formed in the metallic film 3. The opening 3*a* preferably has a substantially rectangular plane shape similar to that of the metallic film 3*a*. The lengthwise dimension (longer side dimension) of the opening 3*a* is preferably substantially parallel to the longitudinal dimension, namely, the longer side dimension, of the metallic film 3.

In this preferred embodiment, the length W of each of the longer sides of the metallic film 3 is about 15 mm, and the length L of each of the shorter sides is about 7 mm. For the opening 3*a*, the length w of each of the longer sides is preferably about 13.5 mm, and the length l of each of the shorter sides is about 0.2 mm. However, the sizes of the metallic film 3 and the opening 3*a* are not limited to the above values. The shapes of the metallic film 3 and the opening 3*a* can be modified, correspondingly to a desired center frequency and bandwidth.

On the other hand, a ground electrode 4 is provided on the entire lower surface of the dielectric substrate 2.

Input-output coupling circuits 5 and 6 are connected to one of the longer sides 3*b* of the metallic film 3, respectively. The position and arrangement of the input-output coupling circuits 5 and 6 are not limited to the positions shown in FIG. 1. The output coupling circuits 5 and 6 may be connected at appropriate positions on the metallic film 3, provided that the positions are different from each other on the metallic film 3.

Figure 3:
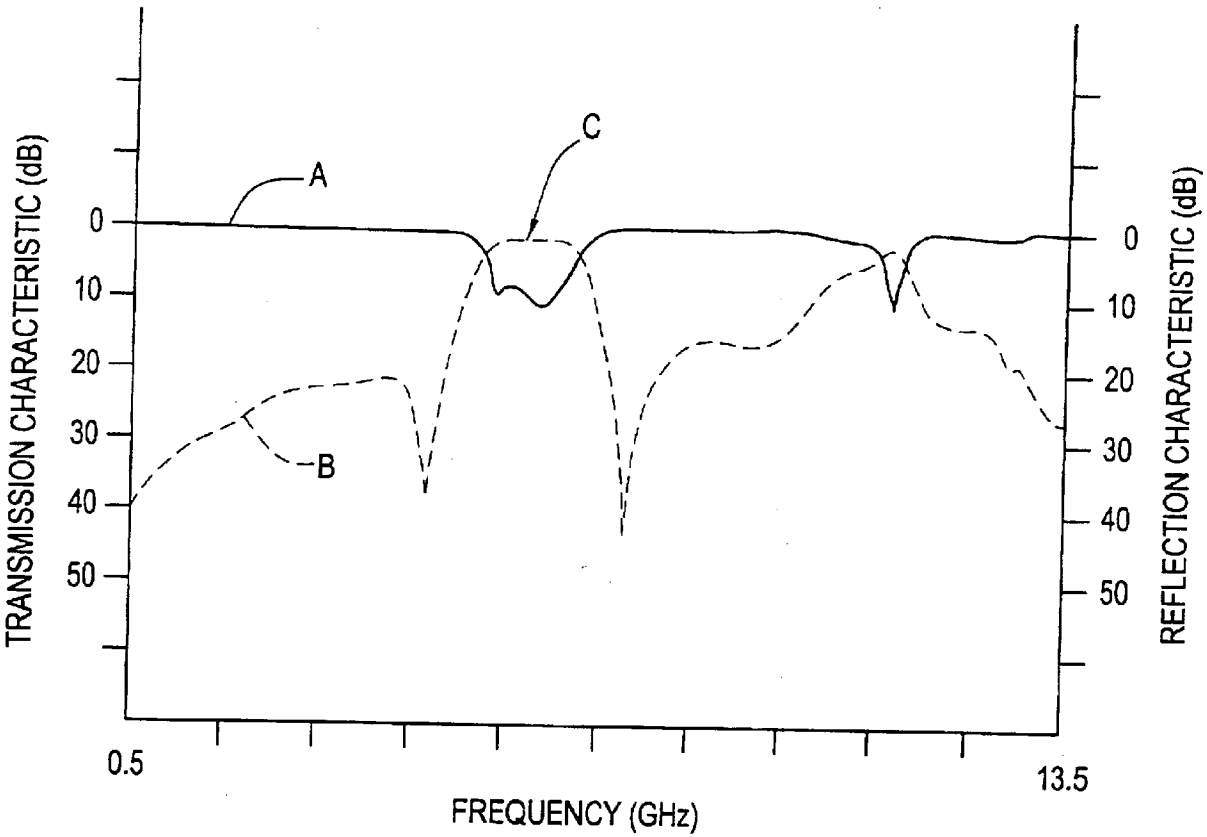
FIG. 3 is a graph showing the frequency characteristics of the dual mode band-pass filter of the first embodiment preferred embodiment of the present invention.

In the dual mode band-pass filter of this preferred embodiment, an input voltage is applied between one of the input-output coupling circuits 5 and 6 and the ground electrode 4, whereby a predetermined output power between the other circuit of the input-output coupling circuits 5 and 6 and the ground electrode 4 is output. In this case, the two resonance modes are coupled to each other, since the metallic film 3 has a substantially rectangular shape, and the opening 3*a* is provided. Thus, this filter operates as a dual mode band-pass filter. FIG. 3 shows the frequency characteristics of the dual mode band-pass filter 1 of this preferred embodiment of the present invention.

In FIG. 3, the reflection characteristic is represented by solid line A, and the transmission characteristic is shown by broken line B (hereinafter, these characteristics will be represented in the same manner). As seen in FIG. 3, a band-pass filter includes a band indicated by arrow C that is used as a transmission band.

In particular, it is seen that in the dual mode band-pass filter of this preferred embodiment, the two resonance modes are coupled to each other, due to the opening 3*a* formed in the metallic film 3, whereby characteristics suitable for the dual mode band-pass filter can be obtained.

By changing the shape of the metallic film 3 in the above-described configuration, various resonance characteristics of the two modes can be obtained. This will be described in reference to a specific example of the first preferred embodiment of the present invention.

Metallic films 3 preferably made of copper, having a substantially rectangular plane shape, and eliminating the opening 3*a*, which had different sizes as listed in TABLE 1, were formed on the dielectric substrate. Thereby, four types of resonators were prepared. In TABLE 1, reference character W represents the length of a longer side of the metallic film 3, and reference character L represents the length of a shorter side thereof.

As resonance modes based on the resonators including these metallic films, the following two modes are probable. A first resonance mode is a $\lambda/2$ resonance mode (resonance frequency $fr_1$) of which the resonator length is the length in the longer side direction of the metallic film 3. A second resonance mode is a $\lambda/2$ resonance mode (resonance frequency $fr_2$) of which the resonator length is the length in shorter side direction of the metallic film 3.

The measurements and calculation values of the resonance frequencies $fr_1$ and $fr_2$ are listed in the following TABLE 1.

Figure 4:
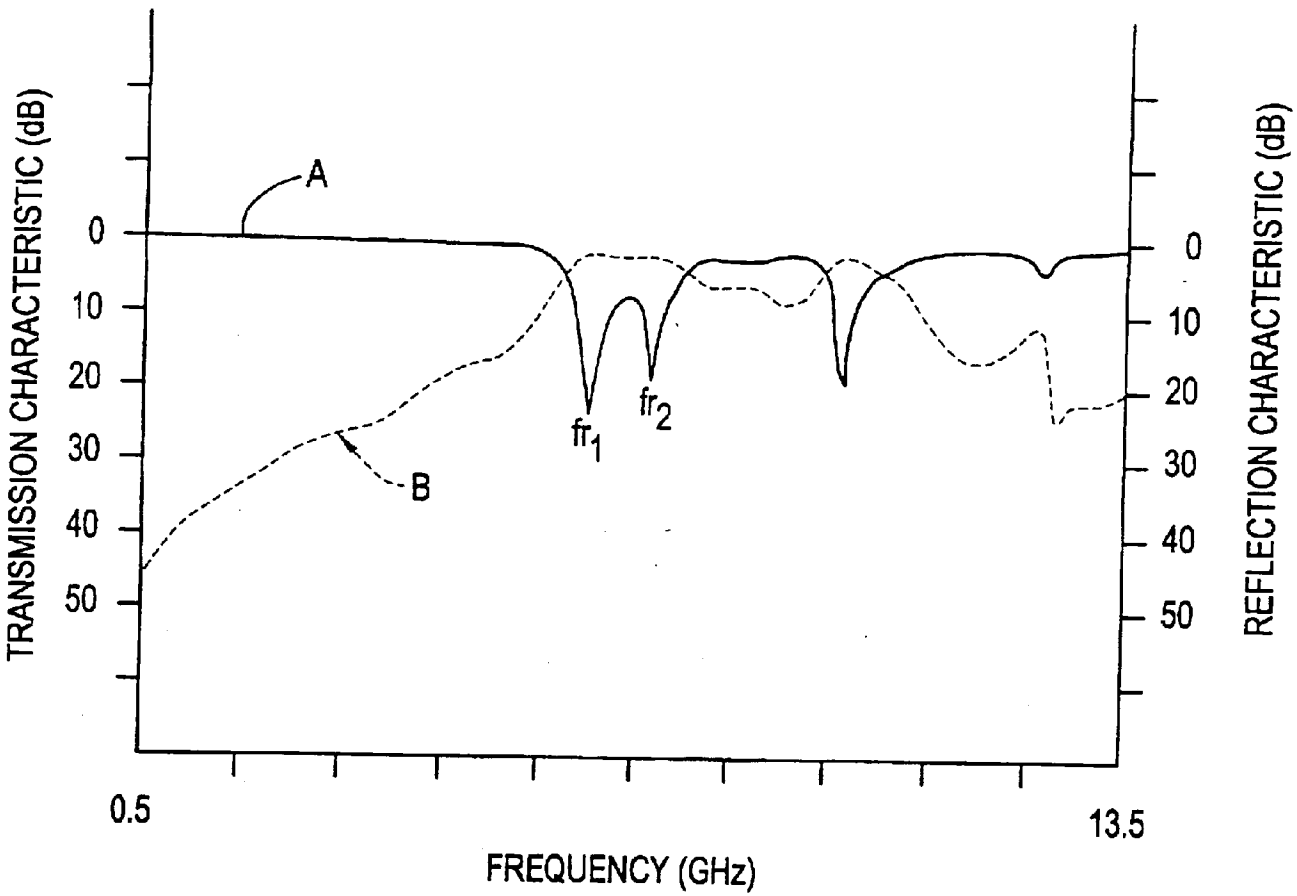
FIG. 4 is a graph showing the frequency characteristics of a resonator produced by forming a substantially rectangular metallic film having no opening on a dielectric substrate.
Figure 5:
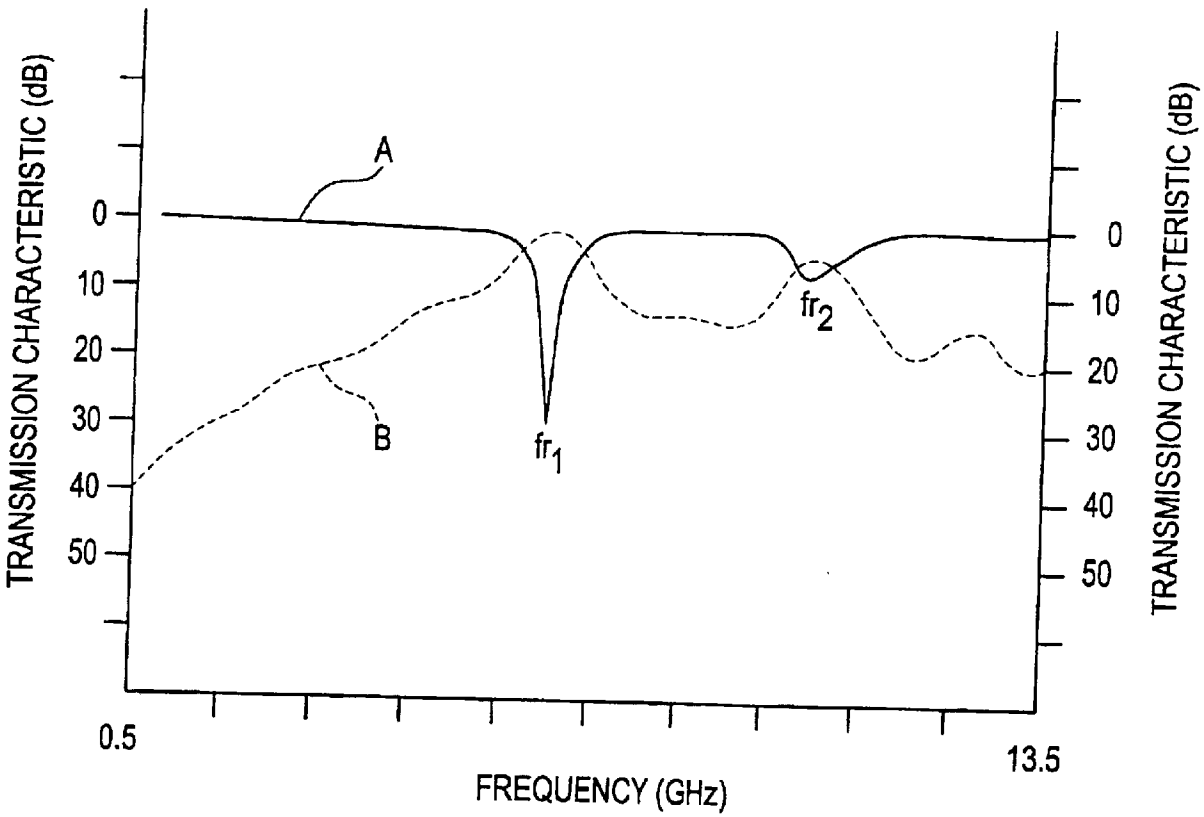
FIG. 5 is a graph showing the frequency characteristics of a dual mode band-pass filter formed according to a specific example of the first preferred embodiment of the present invention, in which the size of the metallic film is approximately 15 mm×7 mm, the length of an opening is about 6 mm, and the width of the opening is about 0.2 mm.
Figure 6:
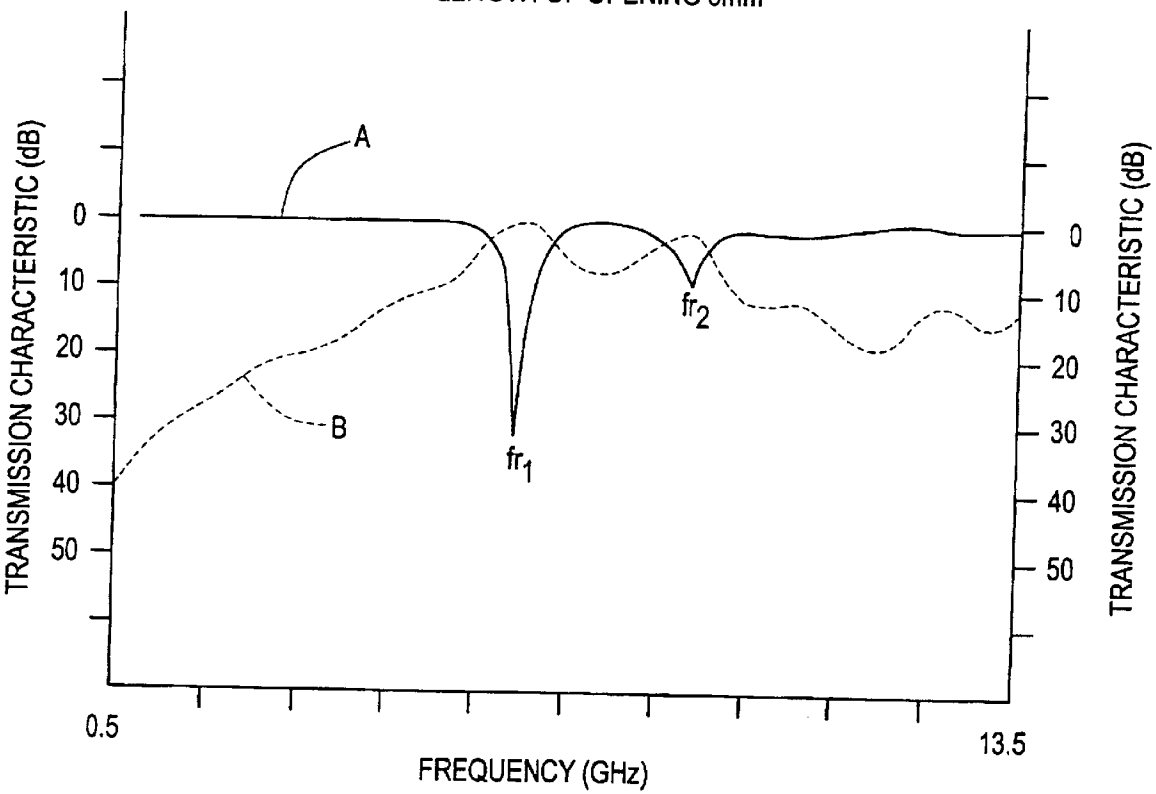
FIG. 6 is a graph showing the frequency characteristics of the dual mode band-pass filter formed according to a specific example of the first preferred embodiment of the present invention, in which the size of the metallic film is approximately 15 mm×7 mm, the length of the opening is about 8 mm, and the width of the opening is about 0.2 mm.
Figure 7:
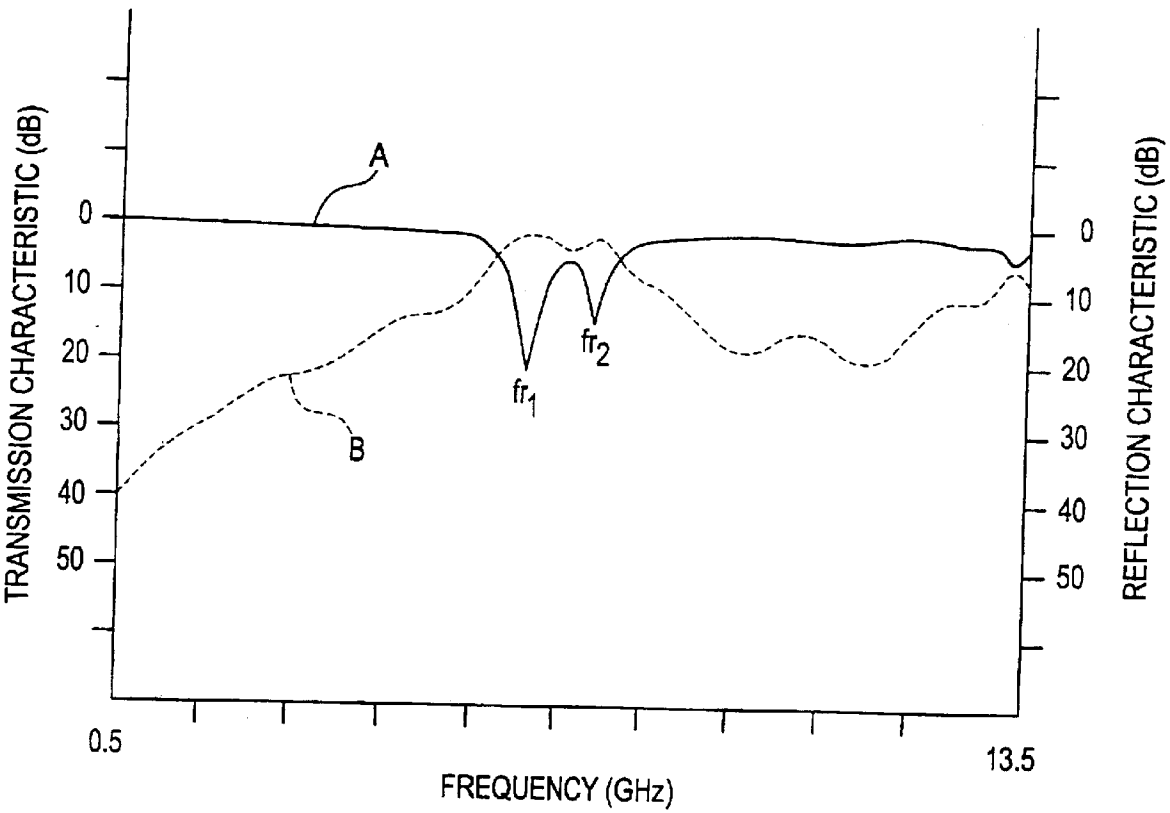
FIG. 7 is a graph showing the frequency characteristics of the dual mode band-pass filter formed according to the specific example of the first preferred embodiment of the present invention, in which the size of the metallic film is approximately 15 mm×7 mm, the length of the opening is about 10 mm, and the width of the opening is about 0.2 mm.
Figure 8:
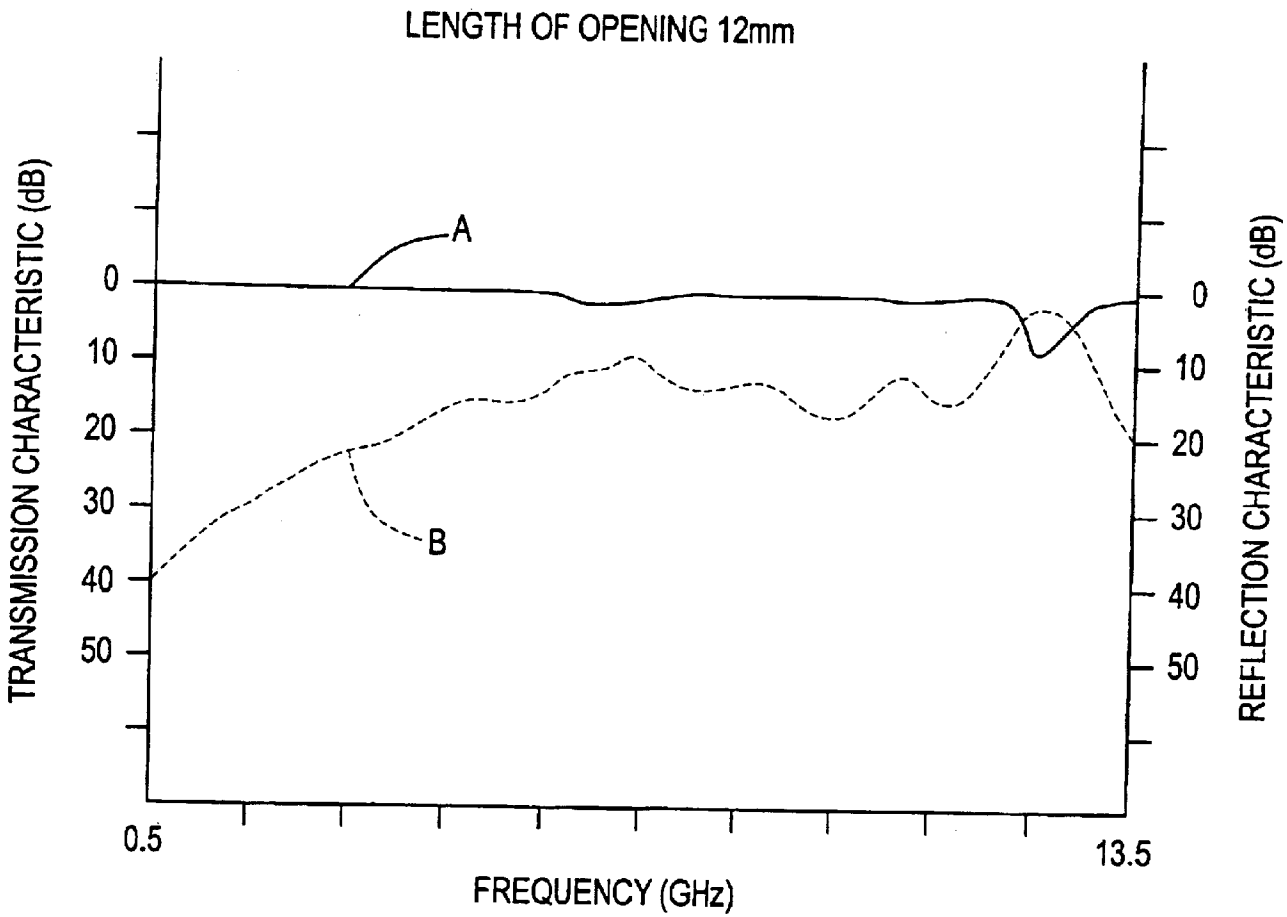
FIG. 8 is a graph showing the frequency characteristics of the dual mode band-pass filter formed according to the specific example of the first preferred embodiment of the present invention, in which the size of the metallic film is approximately 15 mm×7 mm, the length of the opening is about 12 mm, and the width of the opening is about 0.2 mm.

The frequency characteristic of the metallic film 3 with W×L=15×13 mm, eliminating the opening, is illustrated as a typical example in FIG. 4.

TABLE 1

| | measurements | | calculation values | |
|---|---|---|---|---|
| W × L (mm) | $fr_1$ (GHz) | $fr_2$ (GHz) | $fr_1$ (GHz) | $fr_2$ (GHz) |
| 15 × 13 | 6.29 | 7.13 | 6.22 | 7.16 |
| 15 × 11 | 6.22 | 8.63 | 6.22 | 8.48 |

TABLE 1-continued

| | measurements | | calculation values | |
|---|---|---|---|---|
| W × L (mm) | $fr_1$ (GHz) | $fr_2$ (GHz) | $fr_1$ (GHz) | $fr_2$ (GHz) |
| 15 × 9 | 6.16 | 10.51 | 6.22 | 10.37 |
| 15 × 7 | 6.22 | 13.24 | 6.22 | 13.33 |

As seen in TABLE 1, the measurements and the calculation values are substantially coincident with each other. In the above-described results, it is seen that the resonator including the substantially rectangular metallic film 3 has two resonance modes, that is, one resonance mode is a $\lambda/2$ resonance in which the resonator length is the length W of a longer side of the metallic film 3, and the other resonance mode is a $\lambda/2$ resonance in which the resonator length is the length of a shorter side of the metallic film 3.

Hereinafter, it will be described that by forming the opening 3*a* in the substantially rectangular metallic film 3, the above-mentioned two resonance modes can be coupled, whereby a dual mode band-pass filter can be obtained.

Five types of resonators were prepared in which openings 3*a* with a width l of about 0.2 mm and lengths W of approximately 6 mm, 8 mm, 10 mm, 12 mm, and 13.5 mm were formed in a resonator containing the substantially rectangular metallic film 3 with approximate dimensions of W×L of 15×7 mm prepared in the above example.

FIGS. 5 to 9 show the frequency characteristics of the five types of the resonators.

Figure 9:
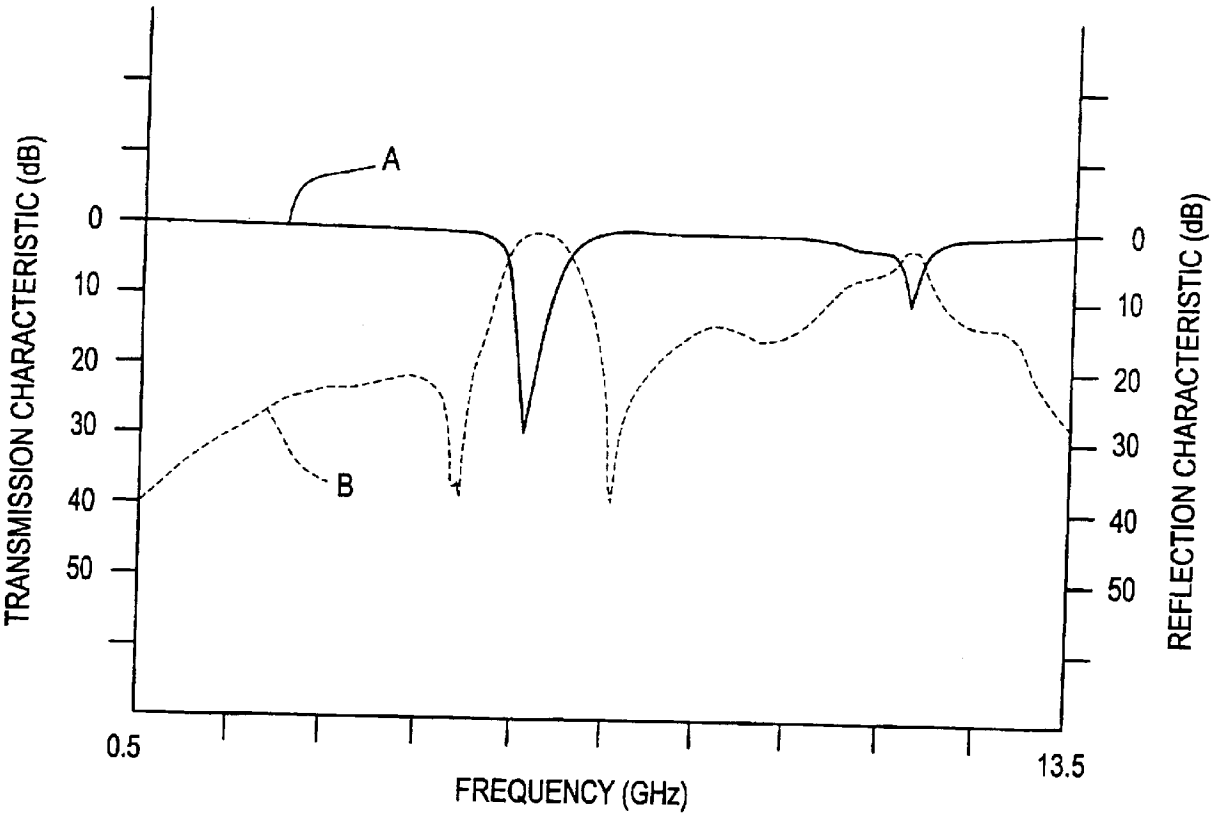
FIG. 9 is a graph showing the frequency characteristics of the dual mode band-pass filter formed according to a specific experimental example of the first preferred embodiment of the present invention, in which the size of the metallic film is approximately 15 mm×7 mm, the length of the opening is about 13.5 mm, and the width of the opening is about 0.2 mm.

As seen in FIGS. 5 to 9, the larger the length W of the opening 3*a* becomes, the more the resonance frequency $fr_2$ of the second resonance mode shifts to the low frequency side. Furthermore, as seen in FIG. 9, when the resonance frequency $fr_2$ becomes lower than the resonance frequency $fr_1$, the resonance frequencies $fr_1$ and $fr_2$ are coupled together, whereby a band-pass filter is defined.

Presumably, in the dual mode band-pass filter of this preferred embodiment of the present invention, the resonance current in the resonance mode propagated in the short-side direction is partially interrupted in the opening 3*a*, so that the resonance current acts as if an inductance were added, and therefore, the resonance frequency $fr_2$ in the resonance mode propagated in the short-side direction is reduced. In other words, in the dual mode band-pass filter of this preferred embodiment, the respective resonance currents flow differently from each other in the two resonance modes in the substantially rectangular metallic film. Accordingly, for the purpose of coupling the two resonance modes as described above, the opening 3*a* is preferably arranged such that the resonance frequency in one of the resonance modes approaches the resonance frequency in the other resonance mode.

As described above, the opening 3*a* is arranged such that the two resonance modes can be coupled together. That is, when the resonator including the substantially rectangular metallic film 3 is used, the lengthwise direction of the opening 3*a* is provided along the longer side direction of the metallic film 3, and moreover, the size in the widthwise direction of the opening 3*a* is selected so that the resonance frequency in the resonance mode propagated in the shorter side direction of the metallic film 3 is reduced to approach the resonance frequency in the resonance mode propagated in the longer side direction of the opening 3*a*.

Accordingly, as described above, the filter can be operated as a dual mode band-pass filter, and moreover, the coupling degree can be controlled freely and accurately by adjusting the size of the opening 3*a*.

Figure 10A:
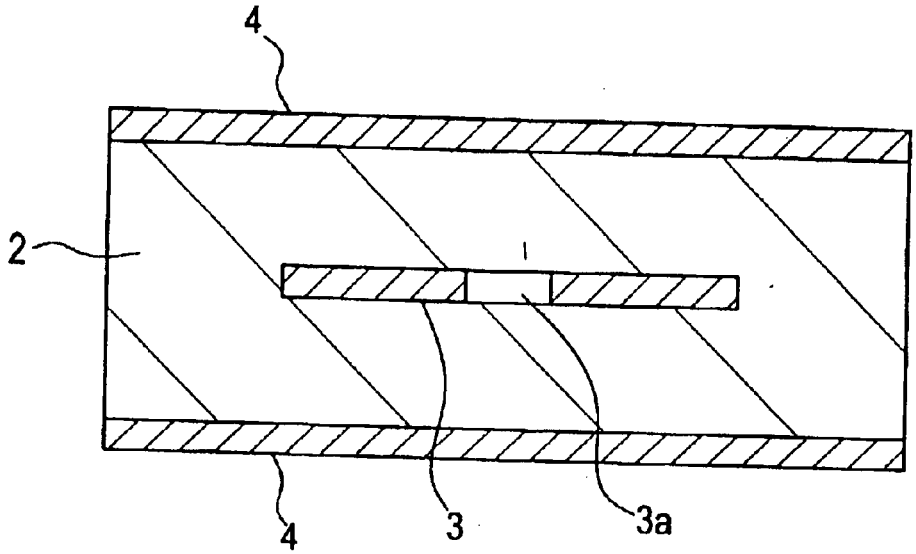
FIG. 10A is a cross-sectional view of a dual mode band-pass filter according to a first modified example of the first preferred embodiment of the present invention.

FIG. 10A is a cross-sectional view of a first modified example of the dual mode band-pass filter according to a first preferred embodiment of the present invention.

In the first preferred embodiment, the metallic film 3 is disposed on the upper surface of the dielectric substrate 2. In the dual mode band-pass filter of the first modified example shown in FIG. 10A, the metallic film 3 having the opening 3*a* is disposed inside of the dielectric substrate 2. The plane shape of the metallic film 3 is similar to that of the first preferred embodiment of the present invention.

Furthermore, ground electrodes 4 are disposed on the entire upper surface and lower surface of the dielectric substrate 1. Accordingly, the dual mode band-pass filter of this modified example has a tri-plate structure. Thus, the dual mode band-pass filter of this preferred embodiment of the present invention may have the tri-plate structure.

It is not necessary to form the ground electrodes 4 on the entire surfaces of the dielectric substrate 2, provided that the ground electrodes 4 are opposed to each other through the metallic film 3 and the dielectric substrate 2 or through a portion of the layers of the dielectric substrate 2. In addition, the ground electrodes 4 may be disposed as internal electrodes in the middle of the dielectric substrate 2.

Figure 10B:
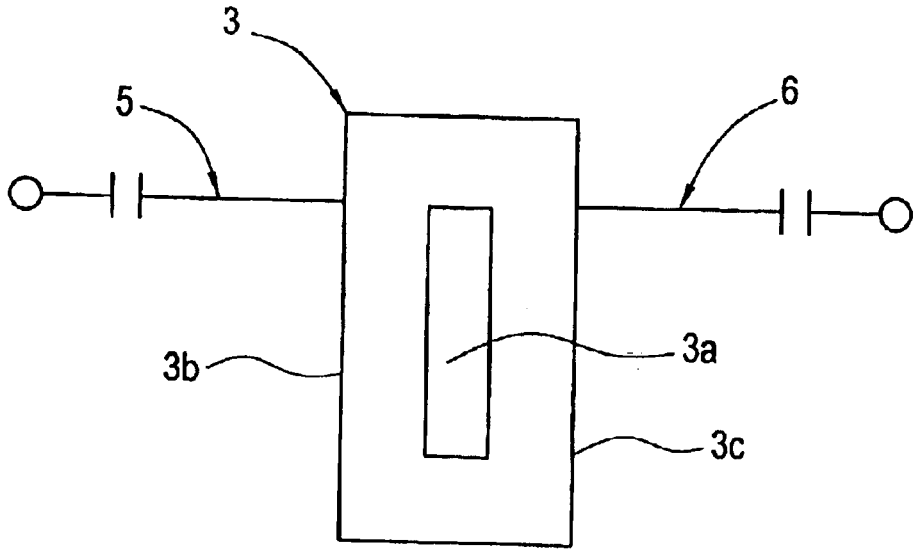
FIG. 10B is a schematic plan view showing the main portion of a dual mode band-pass filter according to a second modified example of the first preferred embodiment of the present invention.

FIG. 10B is a schematic plan view of a second modified example of the dual mode band-pass filter according to the first preferred embodiment of the present invention.

In the dual mode band-pass filter 1 of the first preferred embodiment, the input-output coupling circuits 5 and 6 are connected to one of the longer sides of the substantially rectangular metallic film 3. However, as shown in FIG. 10, the input-output coupling circuits 5 and 6 are connected to the first and second longer sides 3*b* and 3*c*, respectively. The other configuration is preferably similar to that of the first preferred embodiment.

Figure 11:
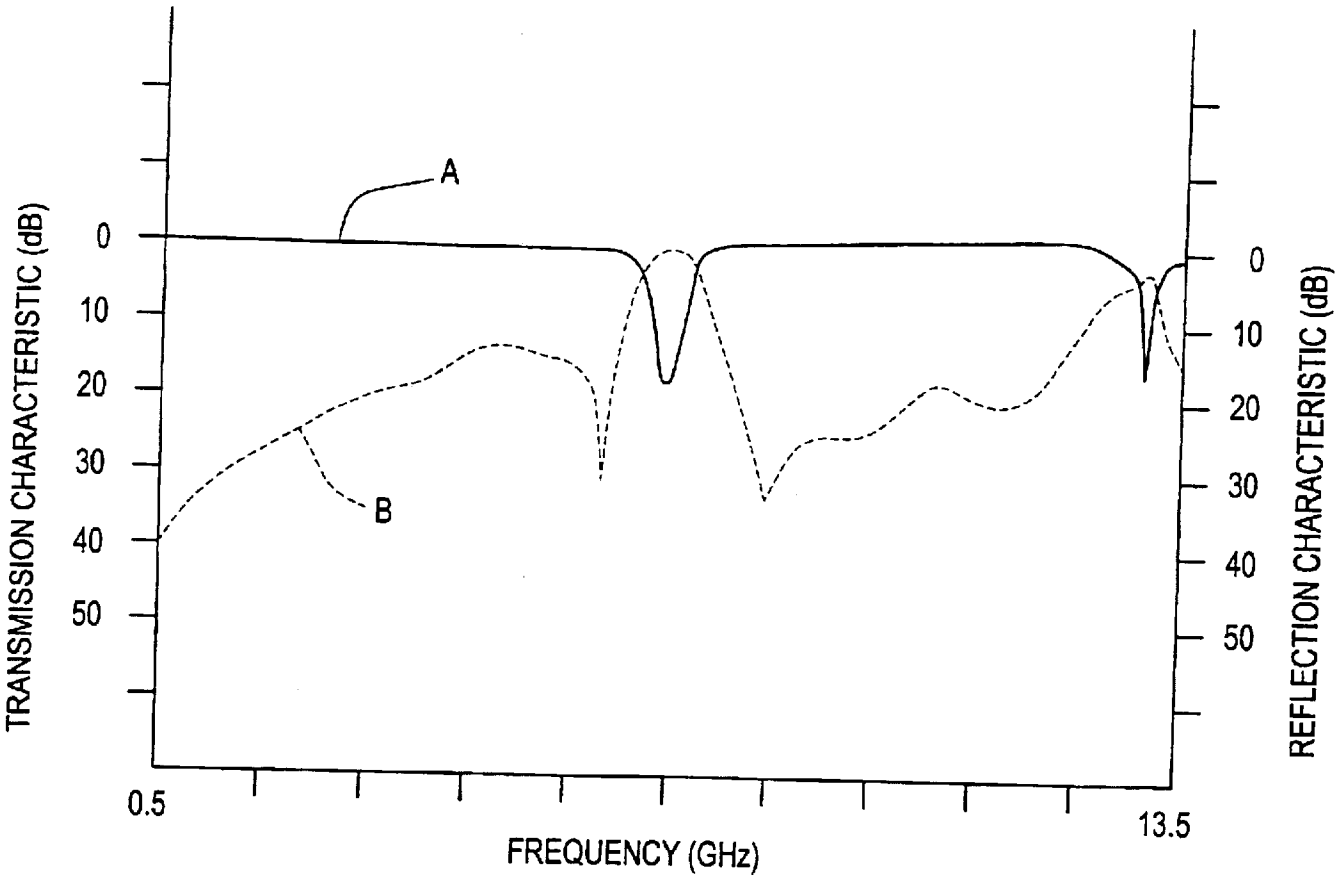
FIG. 11 is a graph showing the frequency characteristics of the dual mode band-pass filter of the second example of the first preferred embodiment of the present invention.

FIG. 11 shows the frequency characteristics of the dual mode band-pass filter of this modified example preferably having the same configuration as the dual mode band-pass filter 1 of the first preferred embodiment except that the connection points of the input-output coupling circuits 5 and 6 of this modification example are different from those of the first preferred embodiment. As seen in FIG. 11, in this modified example of the first preferred embodiment, characteristics suitable for a band-pass filter to be operated in a high frequency band can be obtained. In particular, by comparing FIG. 3 with FIG. 11, it is seen that the band-width can be considerably varied by changing the connection-point positions of the input-output coupling circuits 5 and 6. That is, the adjustment amount of the band-width and the design flexibility are greatly improved.

Figure 12:
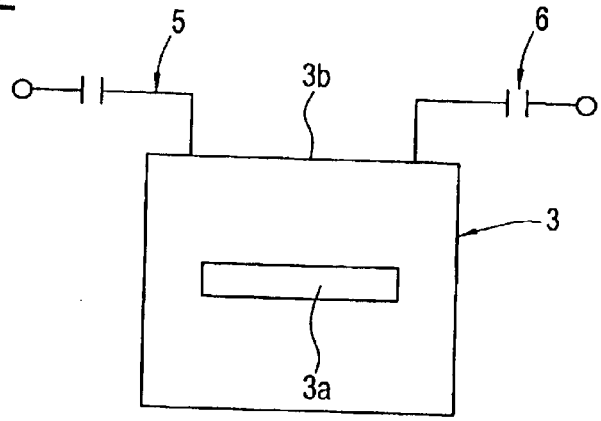
FIG. 12 is a schematic plan view of a dual mode band-pass filter according to a third modified example of the first preferred embodiment of the present invention.

FIG. 12 is a schematic plan view of a third modified example of the dual mode band-pass filter of the first preferred embodiment of the present invention. In this modified example of the first preferred embodiment of the present invention, regarding the metallic film 3, the length of a longer side is preferably about 15 mm and the length of the shorter side is preferably about 13 mm. In other respects, the band-pass filter of this modified example of the first preferred embodiment is configured similarly to the first preferred embodiment.

Figure 13:
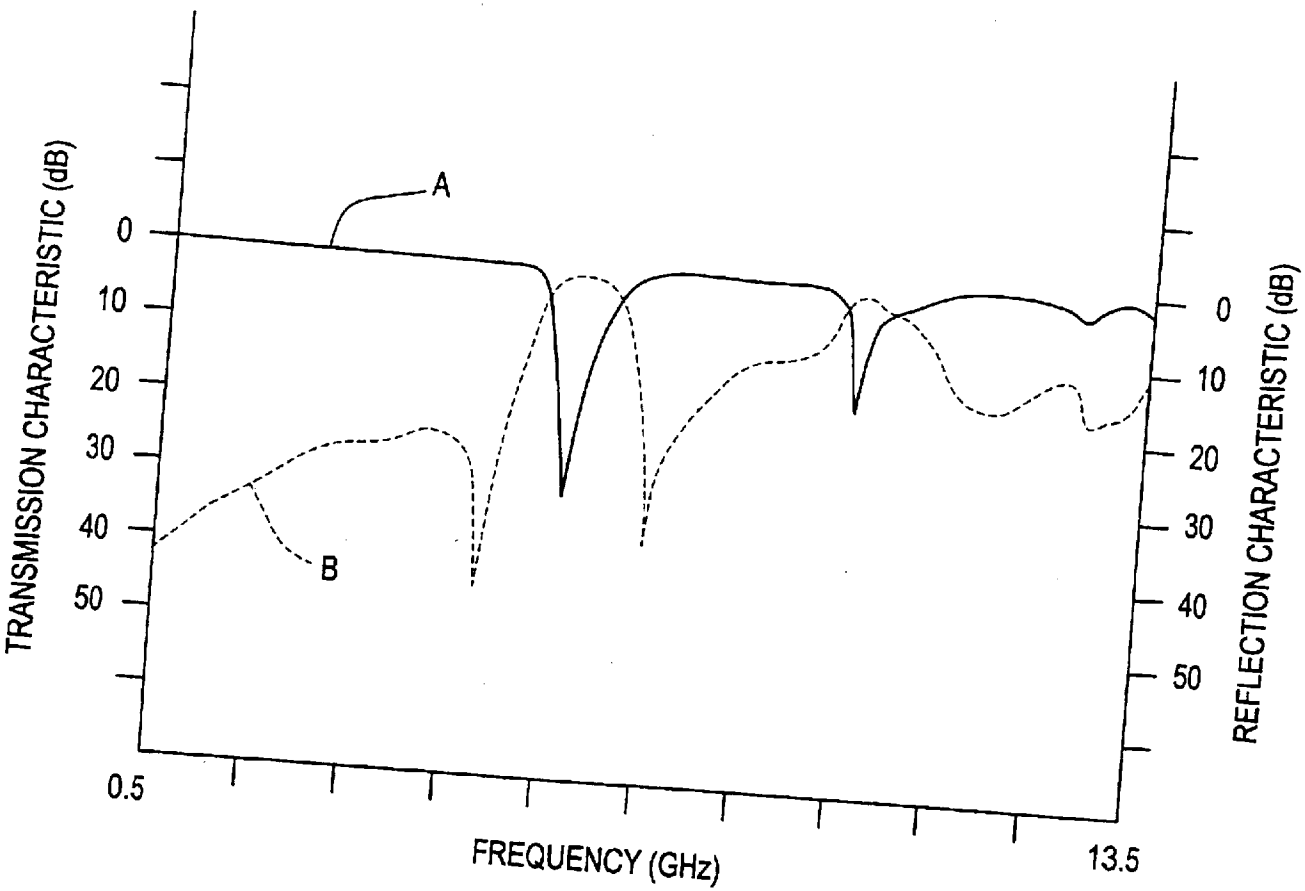
FIG. 13 is a graph showing the frequency characteristic of the dual mode band-pass filter of the third modified example of the first preferred embodiment of the present invention.

FIG. 13 shows the frequency characteristics of the dual mode band-pass filter of the second modified example of the first preferred embodiment of the present invention. As seen in the comparison of FIG. 3 with FIG. 13, the bandwidth can be varied by changing the length of the shorter side of the metallic film 3.

Figure 14:
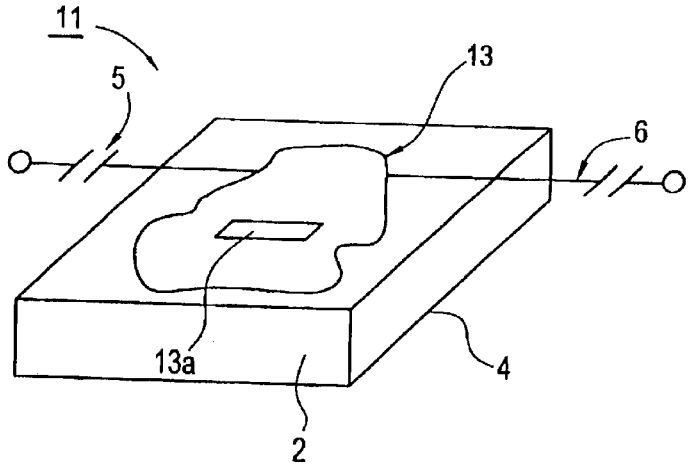
FIG. 14 is a perspective view showing the appearance of a dual mode band-pass filter according to a second preferred embodiment of the present invention.
Figure 15:
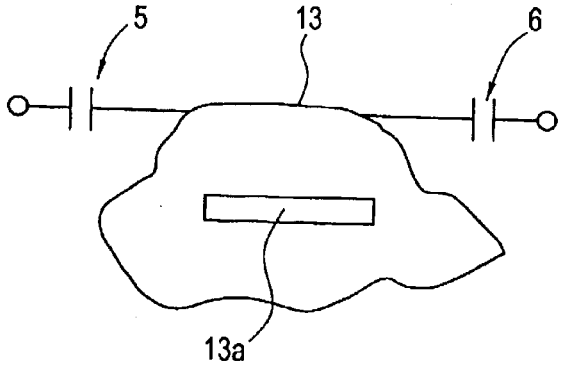
FIG. 15 is a schematic plan view showing the main portion of the dual mode band-pass filter of the second preferred embodiment of the present invention.

FIG. 14 is a perspective view of a dual mode band-pass filter according to a second preferred embodiment of the present invention. FIG. 15 is a schematic plan view showing the main portion of the dual mode band-pass filter.

The dual mode band-pass filter 11 of the second preferred embodiment is configured similarly to the first preferred embodiment except that the shape of a metallic film 13 disposed on the upper surface of the dielectric substrate 2 is different from that of the metallic film 3 of the first preferred embodiment. Accordingly, similar elements are designated by the same reference numerals, and the repeated description is omitted.

In the dual mode band-pass filter of the present invention, the shape of the metallic film constituting a resonator is not limited to that of a substantially rectangular configuration. That is, as shown in FIG. 14, the peripheral edge may have a random contour, that is, may have an optional contour. Also in this case, by forming an opening 13*a* in the metallic film 13 having an optional shape, and connecting the input-output coupling circuits 5 and 6 to two portions of the metallic film 13, a dual mode band-pass filter is provided.

A specific experimental example and the frequency characteristic of the dual mode band-pass filter 11 will be described. The dielectric substrate 2 made of the same material and having the same thickness as that of the first preferred embodiment was prepared. Moreover, the metallic film 13 made of a copper film with a thickness of about 18 $\mu$m and having an optional shape with a maximum diameter of about 15 mm was prepared. A ground electrode was formed on the lower surface of the dielectric substrate 2 similarly to that of the first preferred embodiment.

Referring to the connection points of the input-output coupling circuits 5 and 6, two optional points in the periphery of the metallic film 13 are selected as shown in FIGS. 14 and 15. The opening 13*a* is arranged to be substantially parallel to the straight line passing through the two points.

Figure 16:
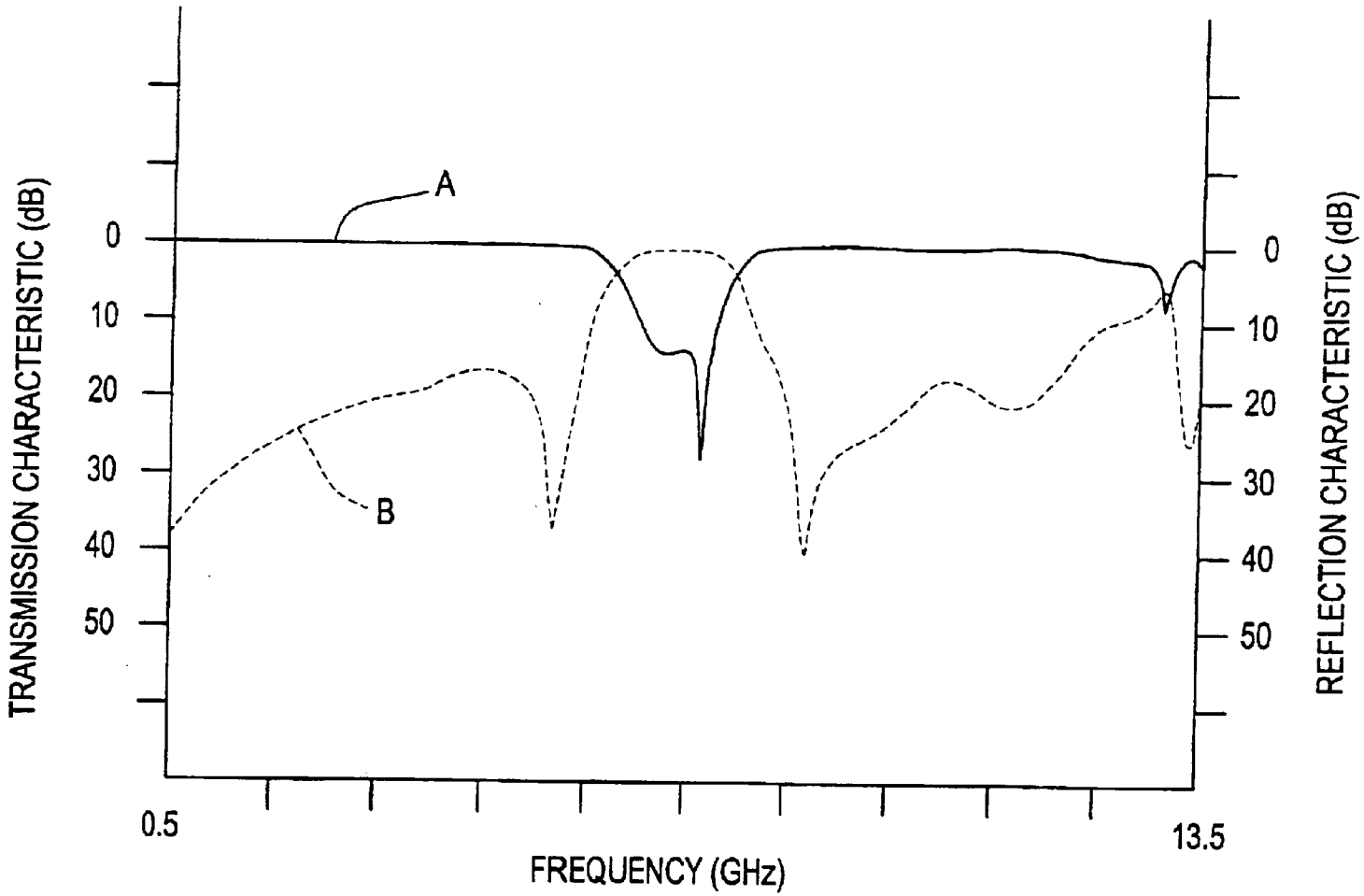
FIG. 16 is a graph showing the frequency characteristics of the dual mode band-pass filter of the second preferred embodiment of the present invention.

FIG. 16 shows the frequency characteristics of the dual mode band-pass filter of the second preferred embodiment.

As seen in FIG. 16, two resonance modes are coupled to each other, whereby a frequency characteristic suitable for a dual mode band-pass filter is achieved. That is, even if the shape of the metallic film 13 is optional, the filter can be operated as a dual mode band-pass filter similarly to that of the first preferred embodiment, by adjusting the length of the substantially rectangular opening 13*a*.

In the second preferred embodiment, the shape of the metallic film 13 is optional, and moreover, the positional relations of the input-output coupling circuits 5 and 6 relative to the metallic film 13 are optional. That is, it is not necessary that the connection points of the input-output coupling circuits 5 and 6 are arranged so as to define an angle of about 90° relative to each other with respect to the approximate center of the metallic film 13.

In the dual mode band-pass filter 11 of the second preferred embodiment of the present invention, the opening 13*a* preferably has a substantially rectangular shape of which the length of a longer side is about 11.5 mm and the length of a shorter side is about 0.2 mm. The shape and size of the opening 13*a* are not limited to the above shape and values. As seen in the description of the first example, the opening in the dual mode band-pass filter of preferred embodiments of the present invention is formed so as to couple two resonance modes. In this case, the resonance frequencies of the two resonance modes are different from each other, depending on the shape of the metallic film and the positions of the connection points of the input-output coupling circuits 5 and 6. Therefore, the shape and size of the opening 13*a* for coupling the two modes are changed correspondingly to the above-mentioned shape and the positions.

That is, the shape and size of the opening 13*a* in the second preferred embodiment are varied, depending on the shape and size of the metallic film 14 and the positions of the connection points of the input-output coupling circuits 5 and 6. Therefore, the shape and size of the opening 13*a* can be accurately determined, correspondingly to the above-mentioned shape and positions.

However, as seen in the description of the first preferred embodiment, the opening 13*a* is formed so as to be substantially parallel to the imaginary straight line passing through the connection points of the input-output coupling circuits 5 and 6. The opening 13*a* interferes the resonance current caused by the resonance propagating in the approximately perpendicular direction relative to the imaginary straight line passing through the above-mentioned connection points, whereby the two resonance modes are coupled. Accordingly, as seen in the specific example of the first preferred embodiment, the two resonance modes can be securely coupled by adjusting the size in the lengthwise direction of the opening 13*a*, provided that two optional points in the periphery of the metallic film 13 are selected as the connection points, and the opening 13*a* is arranged substantially parallel to the straight line passing through the two points. In other words, the opening 13*a* is arranged so that the lengthwise direction of the opening 13*a* is substantially parallel to the imaginary straight line passing through the connection points of the input-output coupling circuits. Moreover, the length of the opening 13*a* is selected so that the two resonance modes, defined by the shape of the metallic film 13, can be coupled.

Figure 17:
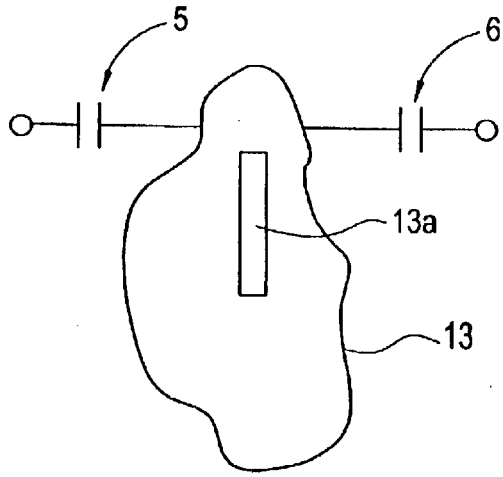
FIG. 17 is a schematic plan view of a dual mode band-pass filter according to a first modified example of the second preferred embodiment of the present invention.

FIG. 17 is a schematic plan view of a first modified example of the dual mode band-pass filter 11 of the second preferred embodiment of the present invention. In this modified example of the second preferred embodiment, the metallic film 13 and the opening 13*a* having substantially the same shape and size as that of the second preferred embodiment is formed. However, the connection points of the input-output coupling circuits 5 and 6 of this modified example are different from those of the second preferred embodiment. That is, the connection points of the input-output coupling circuits 5 and 6 are arranged at the positions opposed to each other on the outer side of the portion of the metallic film 13 where the opening 13*a* is formed, in a direction that is substantially perpendicular to the lengthwise direction of the opening 13*a*. The rest of the configuration is similar to that of the second preferred embodiment.

Figure 18:
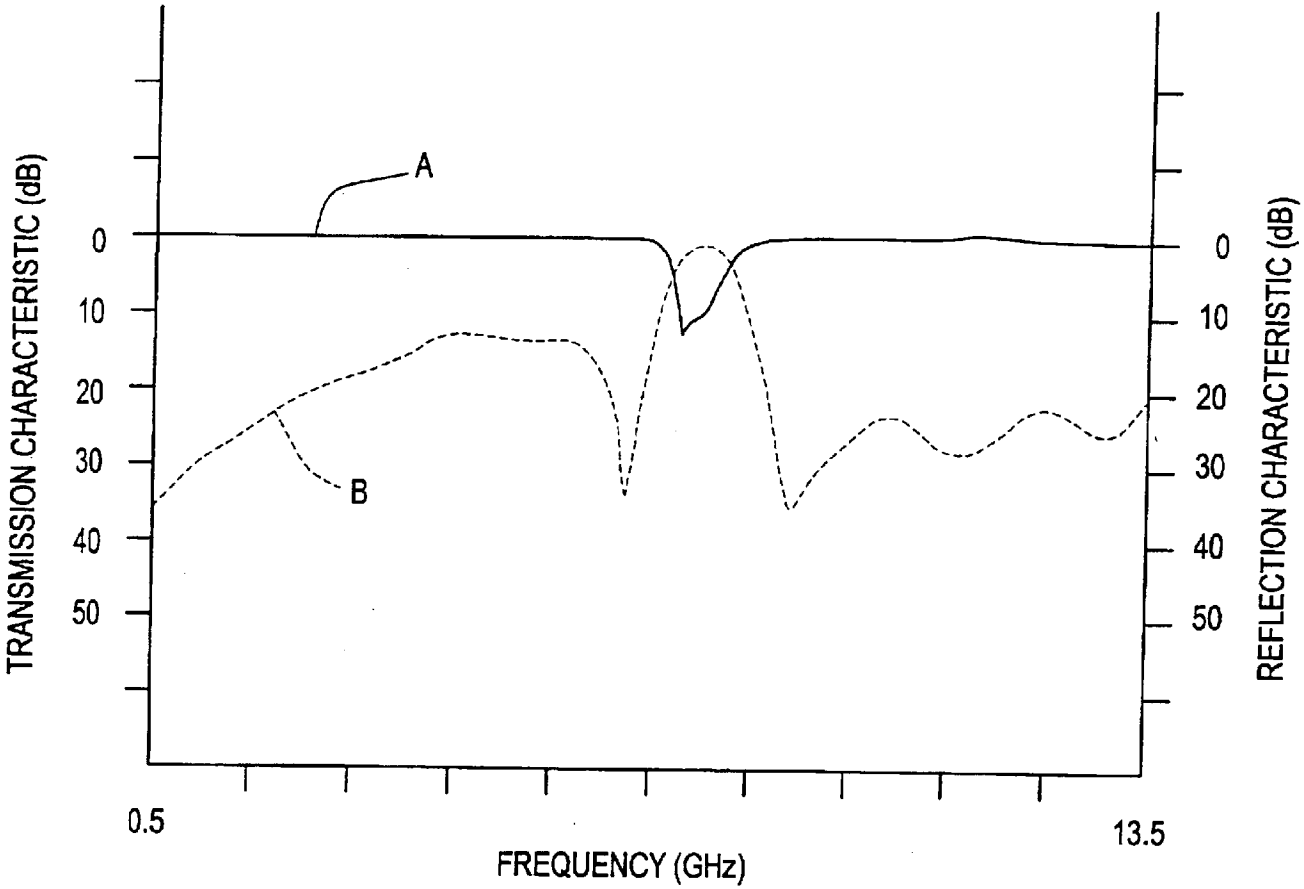
FIG. 18 is a graph showing the frequency characteristics of the dual mode band-pass filter of the first modified example of the second preferred embodiment of the present invention.

FIG. 18 shows the frequency characteristic of the dual mode band-pass filter of the above-described modified example of the second preferred embodiment of the present invention.

By comparing FIG. 16 with FIG. 18, it is seen that the bandwidth of the band-pass filter of the second preferred embodiment is 1390 MHz, and the bandwidth of the band-pass filter of the first modified example is 490 MHz. That is, the bandwidths are equal to about 20% and about 6.5% of the center frequencies of the band-pass filters, respectively, are obtained. Thus, it is seen that by changing the positions of the connection points of the input-output coupling circuits 5 and 6, the bandwidth can be varied, and the coupling degree can be changed.

Figure 19:
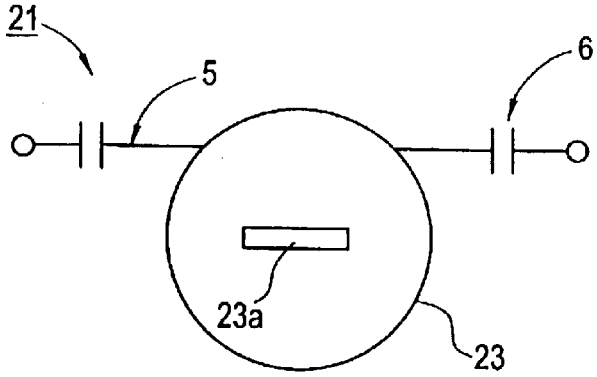
FIG. 19 is a schematic plan view of a dual mode band-pass filter according to a third preferred embodiment of the present invention.

FIG. 19 is a schematic plan view of a dual mode band-pass filter according to a third preferred embodiment of the present invention. In a dual mode band-pass filter 21 of the third preferred embodiment, a metallic film 23 for defining a resonator preferably has a substantially circular shape. A substantially rectangular opening 23*a* is formed in the metallic film 23. It is not necessary that the connection points of the input-output coupling circuits 5 and 6 are located at positions so as to define a center angle of 90° with respect to the substantially circular metallic film 23.

Figure 20:
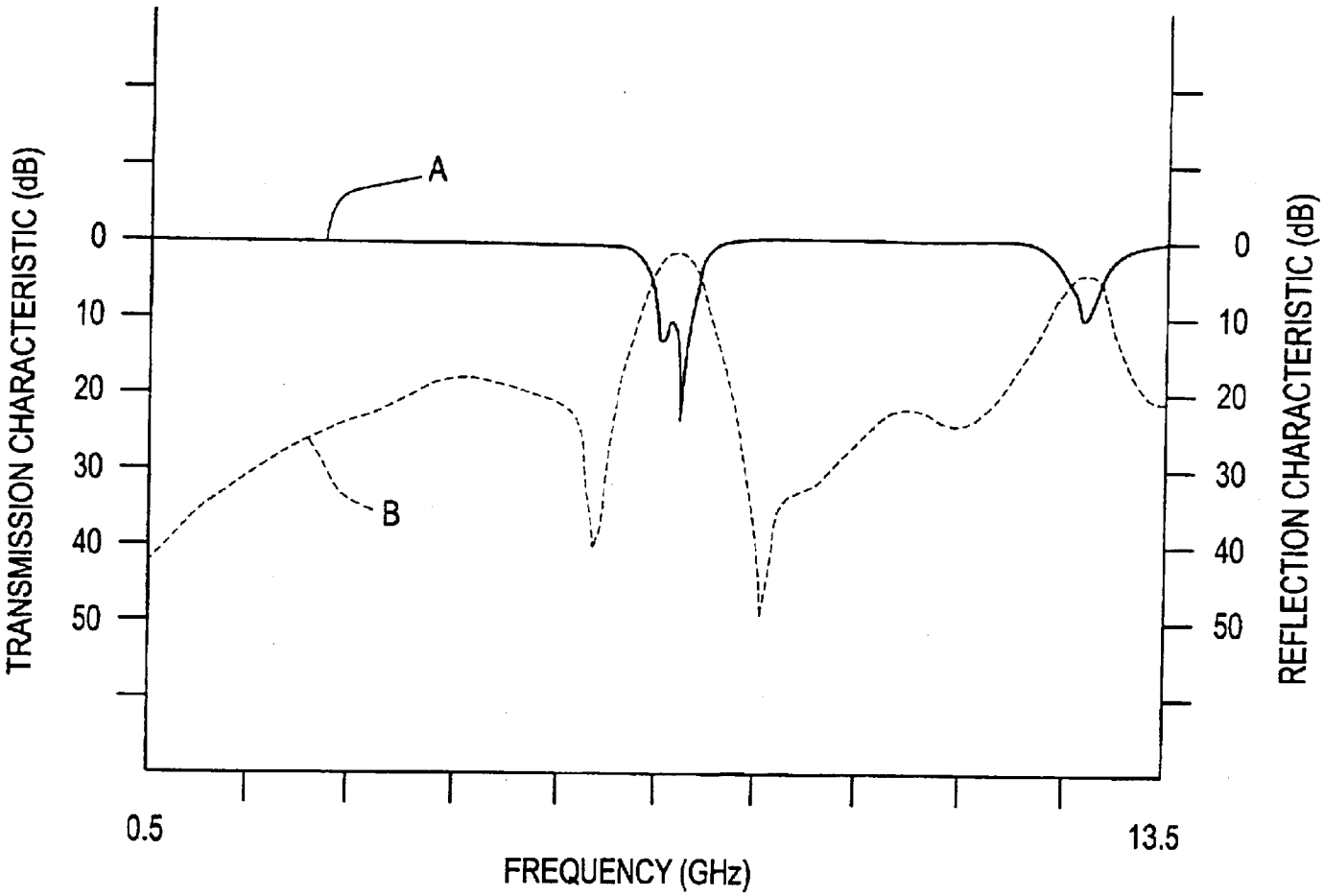
FIG. 20 is a graph showing the frequency characteristics of the dual mode band-pass filter of the third preferred embodiment of the present invention.

FIG. 20 shows the frequency characteristic of the band-pass filter of the third preferred embodiment shown in FIG. 19. The characteristic shown in FIG. 20 is obtained when the substantially circular metallic film 23 has a diameter of about 15 mm, and a substantially rectangular opening 23*a* with the length of a longer side of about 5 mm and the length of a shorter side of about 0.2 mm is provided at a position shifted from the approximate center of the metallic film 23. The other sizes are preferably substantially the same as those of the first preferred embodiment of the present invention.

As seen in FIG. 20, in the third preferred embodiment, a dual mode band-pass filter can be also include a substantially circular metallic film 23*a* having an opening 23*a* formed therein. In particular, when the metallic film is substantially circular, and the substantially rectangular opening 23*a* is formed so that the lengthwise direction of a longer side of the opening 23*a* is substantially parallel to the imaginary line passing through the connection points of the input-output coupling circuits 5 and 6, the resonance current in the resonance mode propagated in a direction that is substantially perpendicular to the imaginary line, not the resonance current in the resonance mode propagated in a direction that is substantially parallel to the imaginary line, is affected by the opening 23*a*, though a circle has an isotropic shape, whereby the two resonance modes are coupled to define a dual mode band-pass filter.

Figure 21:
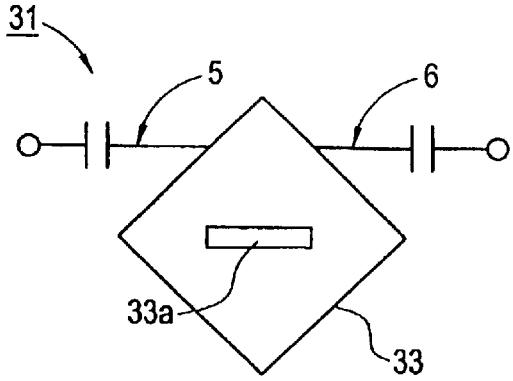
FIG. 21 is a schematic plan view of a dual mode band-pass filter according to a fourth preferred embodiment of the present invention.

FIG. 21 is a schematic plan view of a dual mode band-pass filter according to a fourth preferred embodiment of the present invention. In the dual mode band-pass filter of the fourth preferred embodiment of the present invention, a metallic film 33 constituting a resonator has a substantially square shape. A substantially rectangular opening 33*a* is formed in the metallic film 33. The input-output coupling circuits 5 and 6 are connected to two points in the periphery of the metallic film 33. It is not necessary that the connection points of the input-output coupling circuits 5 and 6 are positioned so as to define a center angle of 90° with respect to the approximate center of the substantially square metallic film 33.

Figure 22:
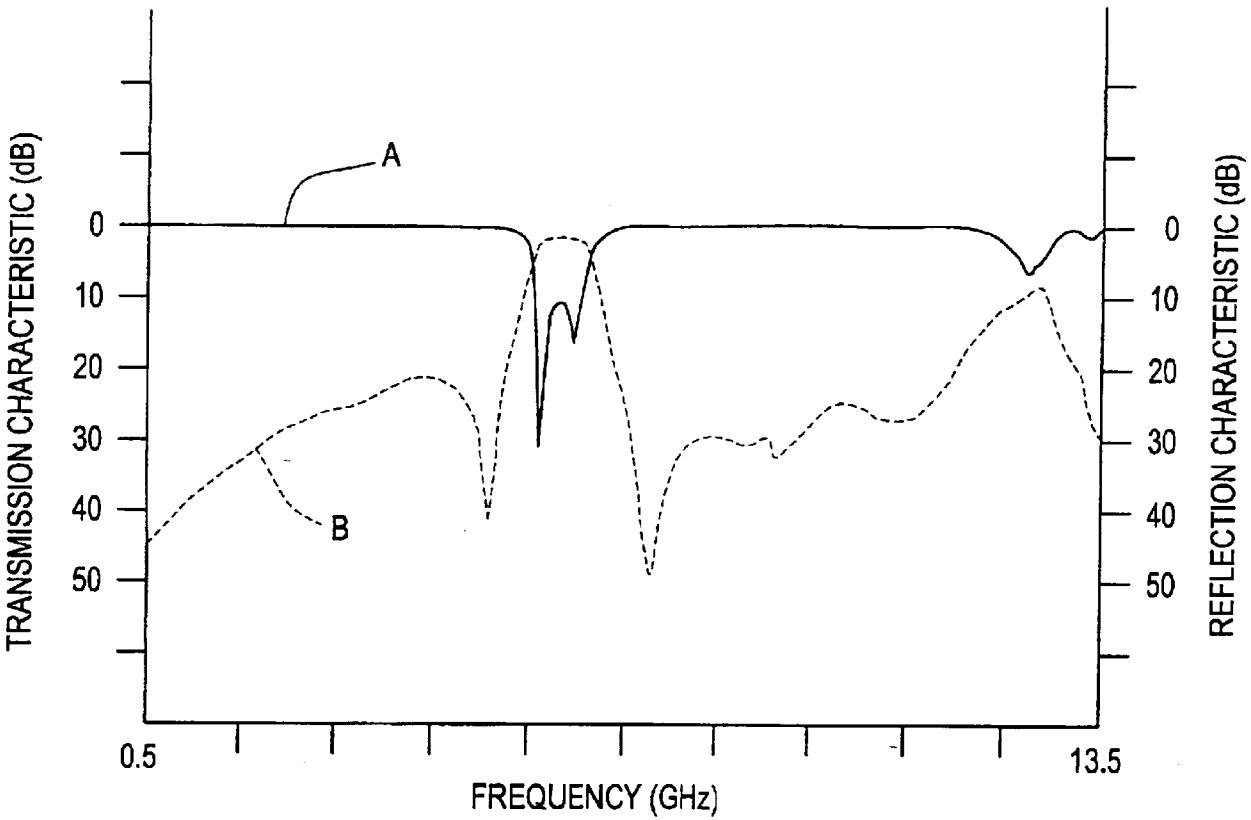
FIG. 22 illustrates the frequency characteristics of the dual mode band-pass filter of the fourth preferred embodiment of the present invention.

FIG. 22 shows the frequency characteristics of the band-pass filter of the fourth preferred embodiment shown in FIG. 21. The characteristics shown in FIG. 22 are obtained when the side length of the square metallic film 33 is about 15 mm, and the opening 33*a* of with the length of a longer side of about 6 mm and that of a shorter side of about 0.2 mm is formed in the square metallic film 33 at a position shifted from the center of the substantially rectangular metallic film 33. The other sizes are preferably substantially the same as those of the first preferably embodiment.

As seen in FIG. 22, also in the third preferred embodiment, a dual mode band-pass filter can include the substantially square metallic film 33 including an opening 33*a*.

Figure 23:
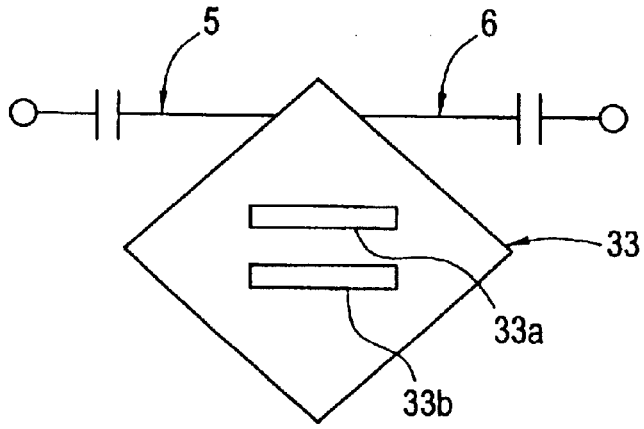
FIG. 23 is a schematic plan view of a dual mode band-pass filter according to a first modified example of the fourth preferred embodiment of the present invention.

FIG. 23 is a schematic plan view of a first modified example of the dual mode band-pass filter of the fourth preferred embodiment. In the fourth preferred embodiment, one opening 33*a* is preferably formed. However, a plurality of openings 33*a* and 33*b* may be formed, as shown in FIG.

Figure 24:
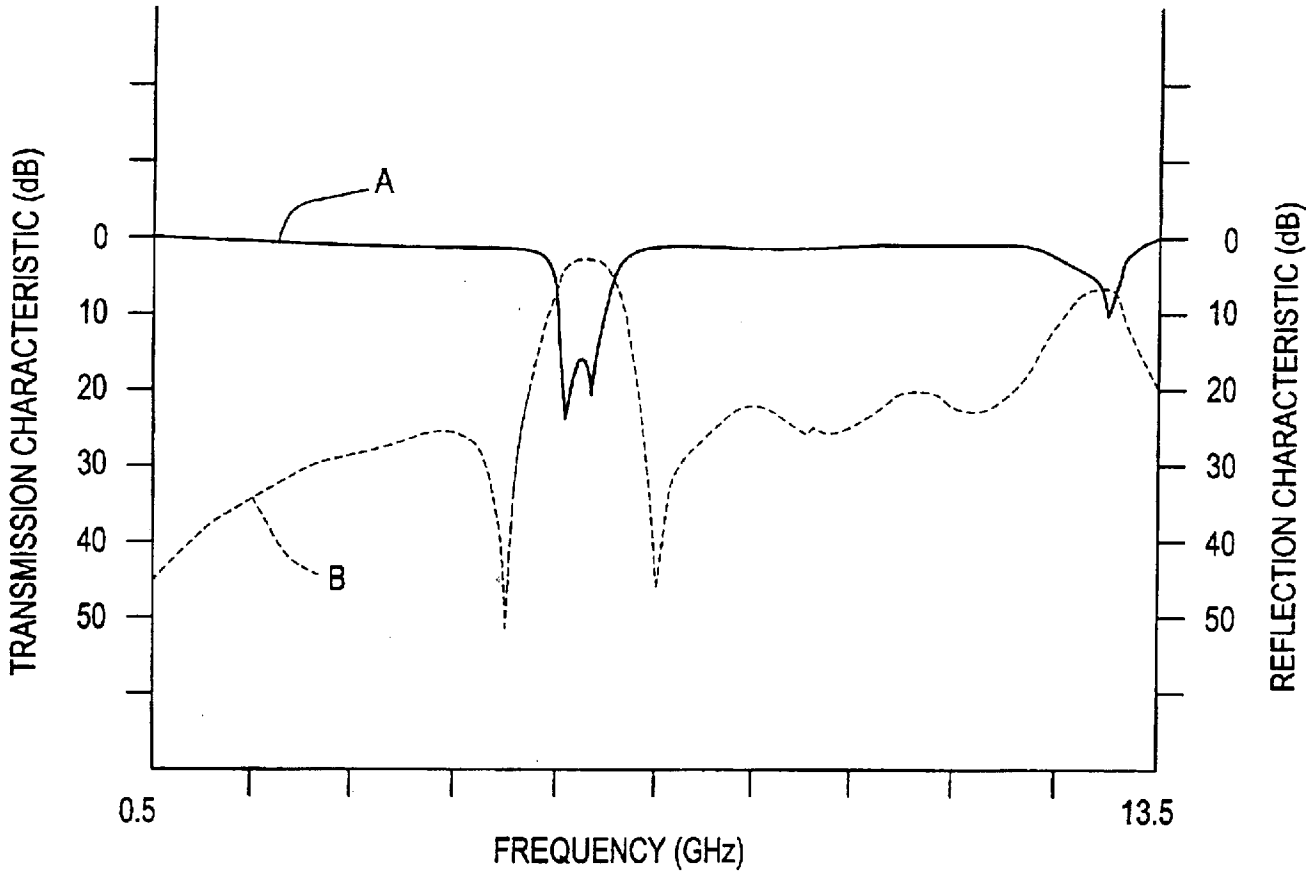
FIG. 24 is a graph showing the frequency characteristics of the dual mode band-pass filter of the first modified example of the fourth preferred embodiment of the present invention.

23. FIG. 24 shows the frequency characteristic of a modified example of the band-pass filter shown in FIG. 23. The opening 33*b* preferably has the same size as the opening 33*a*. The openings 33*a* and 33*b* are preferably arranged to be substantially parallel to each other at an interval of about 2 mm. The other sizes are preferably substantially the same as those of the fourth preferred embodiment.

Figure 25:
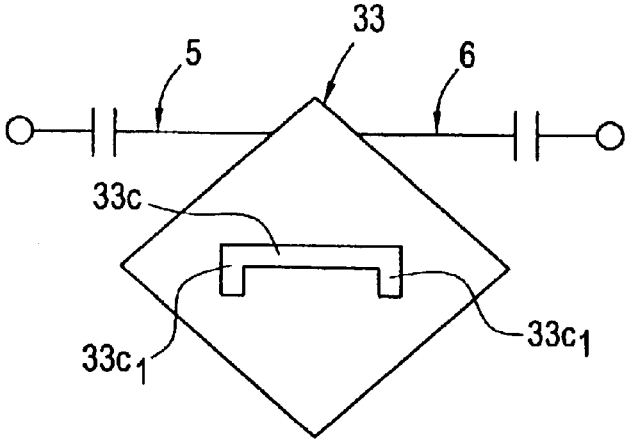
FIG. 25 is a schematic plan view of a dual mode band-pass filter according to a second modified example of the fourth preferred embodiment of the present invention.
Figure 26:
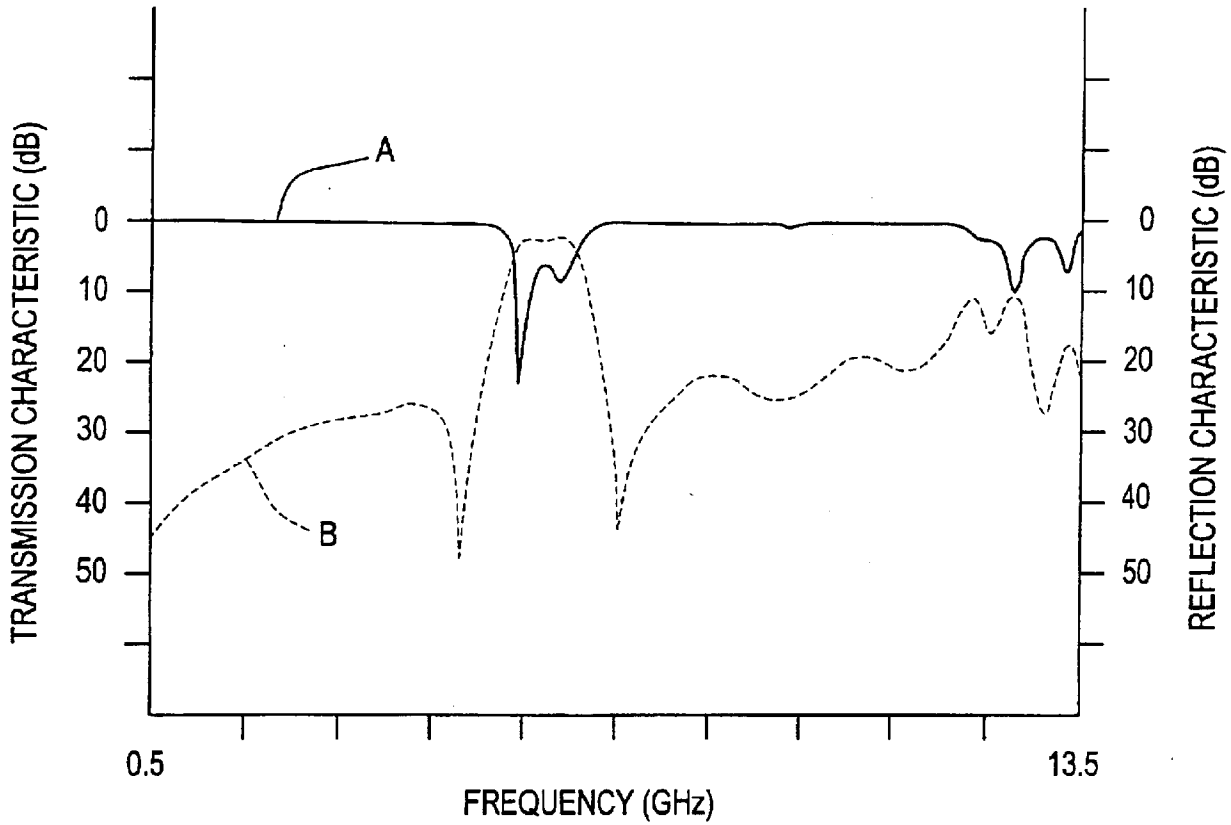
FIG. 26 is a graph showing the frequency characteristics of the dual mode band-pass filter of the second modified example of the fourth preferred embodiment of the present invention.

FIG. 25 is a schematic plan view of a second modified example of the band-pass filter of the fourth preferred embodiment of the present invention. FIG. 26 shows the frequency characteristic thereof. In the dual mode band-pass filter of the second modified example of the fourth preferred embodiment, an opening 33*c* is formed in a metallic film 33. The opening 33*c* has bent portions $\mathbf{33}c_1$ and $\mathbf{33}c_1$ that are bent in a direction that is substantially perpendicular to the lengthwise direction of the opening 33*a* (fourth preferred embodiment) at both ends thereof. FIG. 26 shows the frequency characteristics obtained where the length of each bent portion is about 0.7 mm.

As seen in FIGS. 25 and 26, the opening 33*a* is not limited to a substantially rectangular shape and may have a shape in which the above-mentioned bent portions $\mathbf{33}c_1$ and $\mathbf{33}c_1$ are provided at both ends of a substantially rectangular shape.

Figure 27:
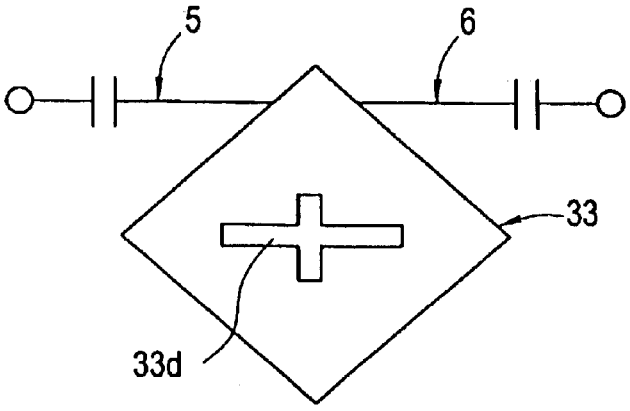
FIG. 27 is a schematic plan view of a dual mode band-pass filter according to a third modified example of the fourth preferred embodiment of the present invention.
Figure 28:
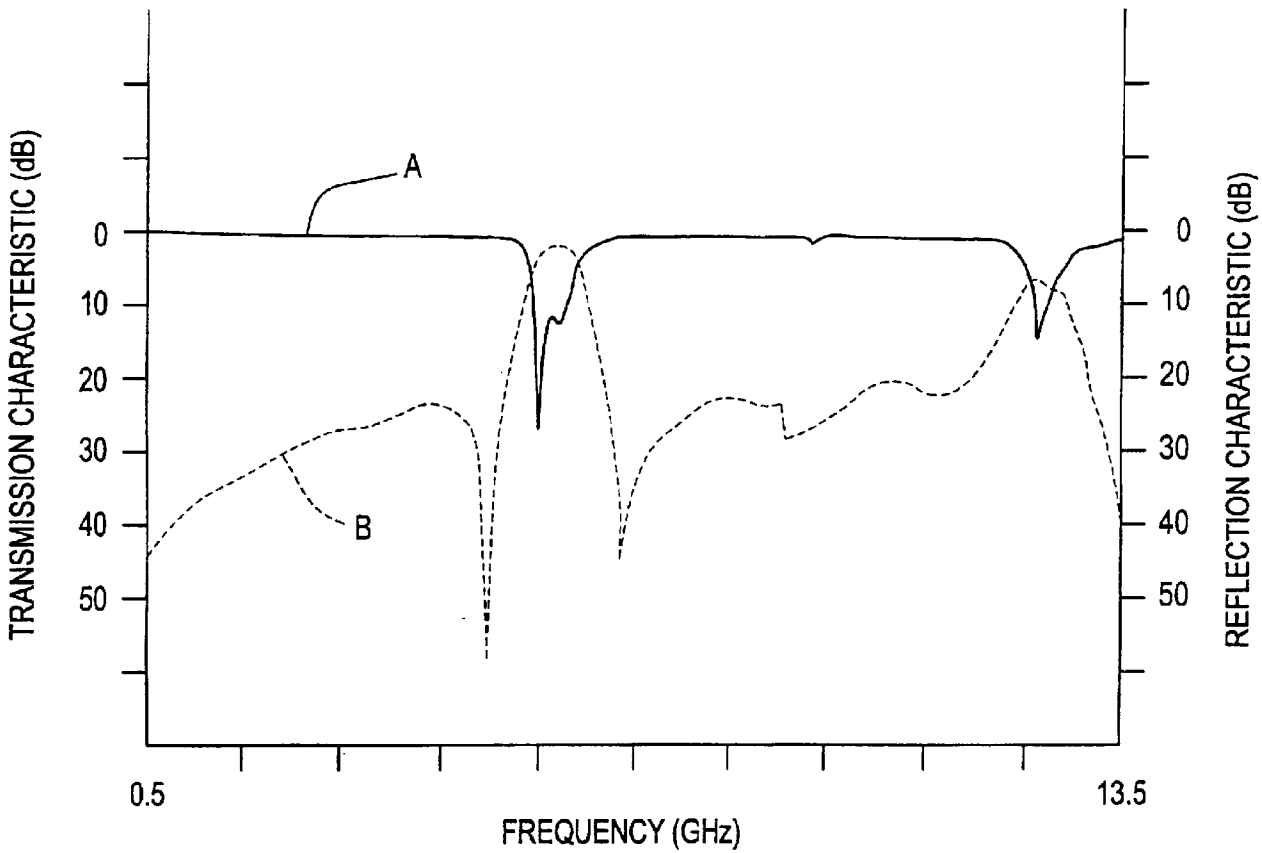
FIG. 28 illustrates the frequency characteristics of the dual mode band-pass filter of the third modified example of the fourth preferred embodiment of the present invention.

FIG. 27 is a schematic plan view of a third modified example of the dual mode band-pass filter of the fourth preferred embodiment. FIG. 28 shows the frequency characteristics thereof. In the dual mode band-pass filter of the third modified example of the fourth preferred embodiment, a cross-shaped opening 33*d* is formed in the metallic film 33. The configuration of the cross-shaped opening 33*d* corresponds to two substantially rectangular openings crossed at a right angle, with one substantially rectangular opening thereof having a longer side length of about 7 mm and a shorter side length of about 0.2 mm, the other substantially rectangular opening having a longer side length of about 4 mm and a shorter side length of about 0.2 mm. As seen in FIGS. 27 and 28, in the case in which the cross-shaped opening 33*d* is formed in the metallic layer, a dual mode band-pass filter can be also provided similarly to the fourth preferred embodiment.

As seen in the first to the third modified examples of the fourth preferred embodiment, in the dual mode band-pass filter of the present invention, a plurality of openings may be provided, and not only a substantially rectangular opening but also an opening having bent portions, and moreover, a cross-shaped opening may be used. That is, the shape of the opening has no special limitations. In addition to the above-mentioned different types of shapes such as rectangles and deformed rectangles, ellipses, circles, and other shapes can be optionally used. Furthermore, shapes such as ellipses or other polygonal shapes, excluding rectangles, which have bent portions connected thereto as described above also may be used. A filter containing any of the above openings can be operated as a dual mode band-pass filter by adjusting the shape and size of the opening, similarly to the filter of each of the first to fourth preferred embodiments. Preferably, the opening has a symmetric shape in the resonance direction of at least one of the two resonance modes.

Figure 29:
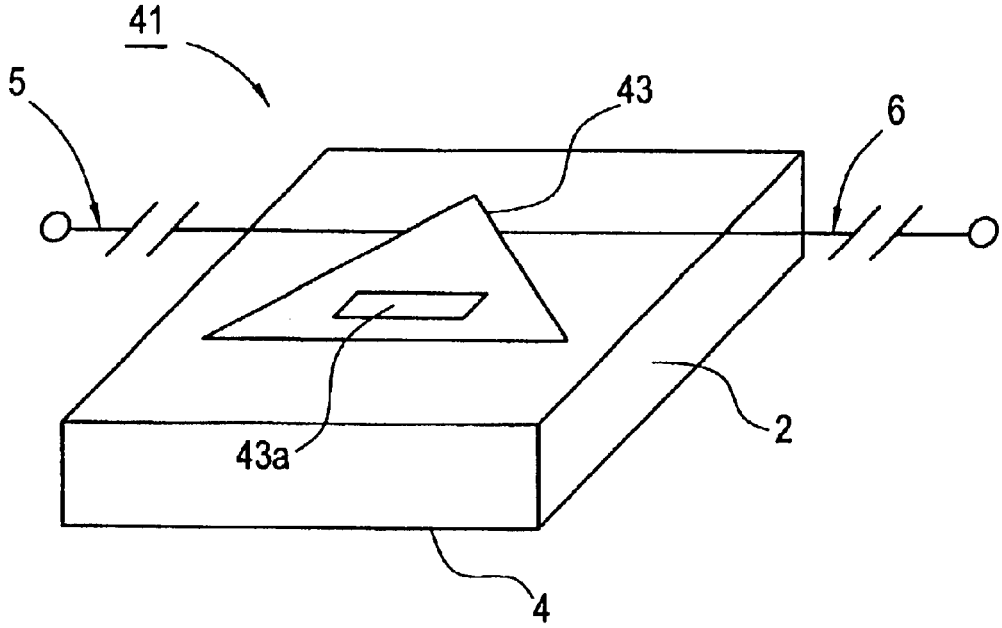
FIG. 29 is a perspective view of a dual mode band-pass filter according to a fifth preferred embodiment of the present invention.
Figure 30:
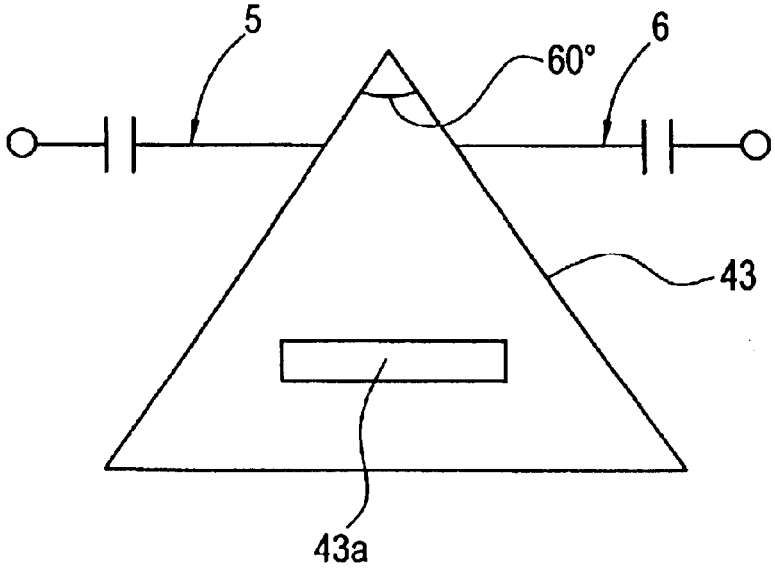
FIG. 30 is a schematic plan view showing the main portion of the dual mode band-pass filter of the fifth preferred embodiment of the present invention.
Figure 31:
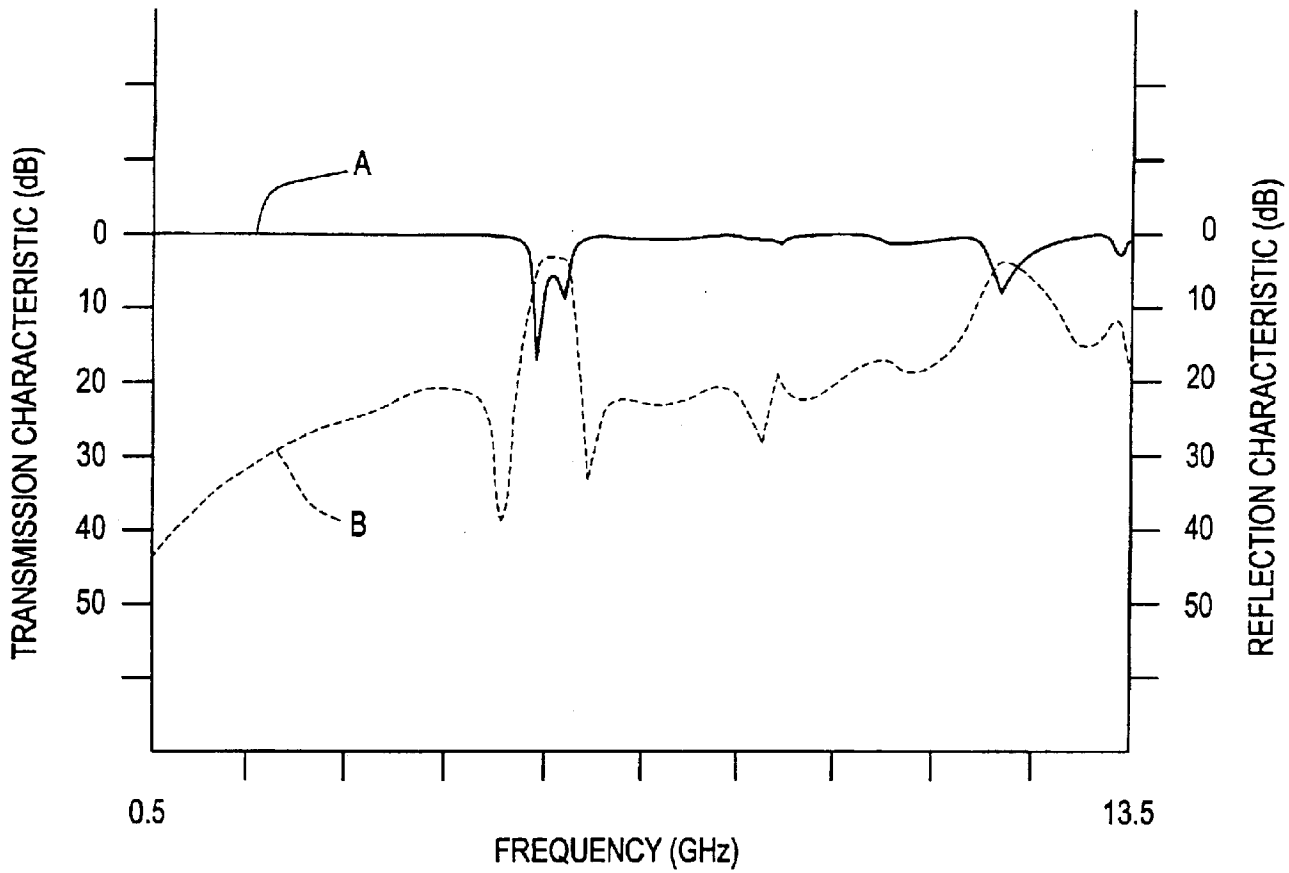
FIG. 31 is a graph showing the frequency characteristics of the dual mode band-pass filter of the fifth preferred embodiment of the present invention.

FIG. 29 is a perspective view of a dual mode band-pass filter according to the fifth preferred embodiment of the present invention. FIG. 30 is a schematic plan view showing the major portion of the band-pass filter. FIG. 31 shows the frequency characteristics of the band-pass filter.

In the dual mode band-pass filter 41 of the fifth preferred embodiment, a metallic film 43 constituting a resonator is arranged to have a substantially triangular shape. In the other respects, the dual mode band-pass filter 41 is preferably similar to that of the first preferred embodiment of the present invention.

A ground electrode 4 is disposed on the same dielectric substrate 2 as that of the first preferred embodiment. The substantially equilaterally triangular metallic film 43 with the length of one side of about 21 mm is provided. An opening 43*a* with the length of a longer side of about 10 mm and that of a shorter side of about 0.2 mm is formed in the metallic film 43. The input-output coupling circuits 5 and 6 are connected to the different sides of the metallic film 43 at the positions thereof which are shifted from the opening 43*a*. The input-output coupling circuits 5 are not limited to the connection points shown in FIGS. 29 and 30. That is, it is not necessary that the input-output coupling circuits 5 and 6 are arranged so that the connection points define a center angle of 90° with respect to the center of the metallic film 43. Thus, the design flexibility is greatly increased.

As shown in FIG. 31, in the case of the metallic film 43 having the substantially equilaterally triangular shape, the filter can be also operated as a dual mode band-pass filter similarly to the band-pass filter of each of the first to fourth preferred embodiments.

In the fifth preferred embodiment, the metallic film 43 has a substantially equilateral triangle shape. It is not necessary that the shape of the metallic film 43 is an equilateral triangle. The metallic film 43 in this preferred embodiment may have the shape of an isosceles triangle or other substantially triangular shape.

Figure 32:
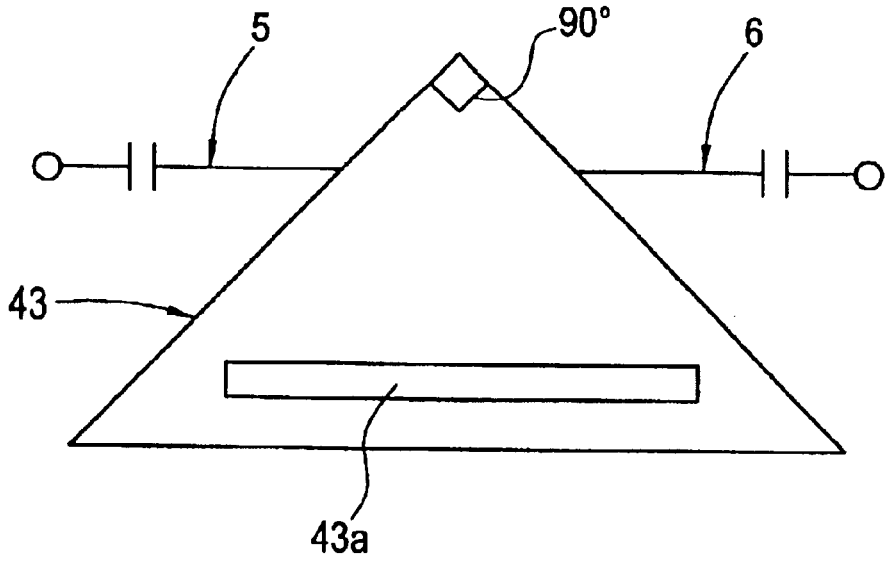
FIG. 32 is a schematic plan view showing a dual mode band-pass filter according to a first modified example of the fifth preferred embodiment of the present invention.
Figure 33:
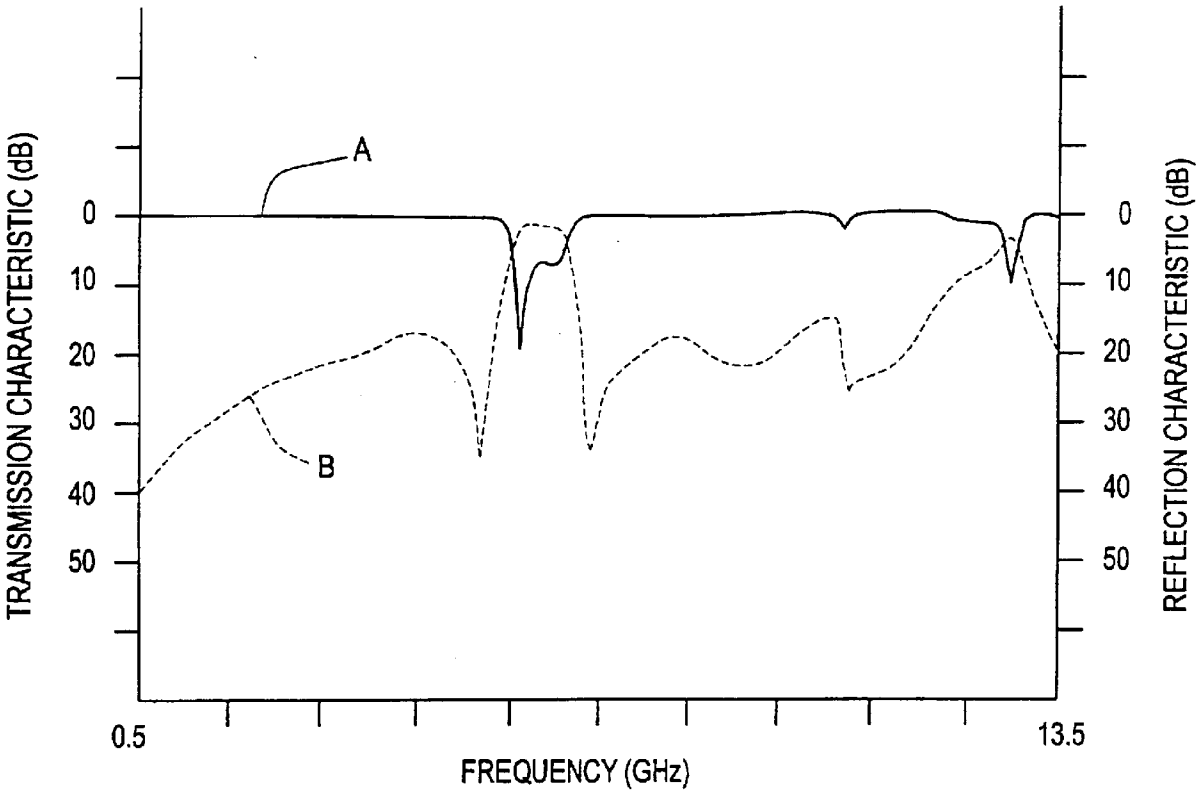
FIG. 33 is a graph showing the frequency characteristics of the dual mode band-pass filter of the first modified example of the fifth preferred embodiment of the present invention.

FIG. 32 is a schematic plan view of a first modified example of the dual mode band-pass filter of the fifth preferred example. FIG. 33 shows the frequency characteristics of the first modified example of the present invention. The dual mode band-pass filter of the first modified example of the fifth preferred embodiment of the present invention is preferably formed in the same manner as that of the fifth preferred embodiment except that the plan shape of the metallic film 43 is a right isosceles triangle of which the vertical angle is approximately 90°, and the length of the base is about 21 mm. As seen in FIGS. 32 and 33, when using the metallic film 43 having the right triangle configuration, the band-pass filter can be operated as a dual mode band-pass filter by forming an opening 43*a*, and connecting the input-output coupling circuits 5 and 6 to two locations of the metallic film 43.

Figure 34:
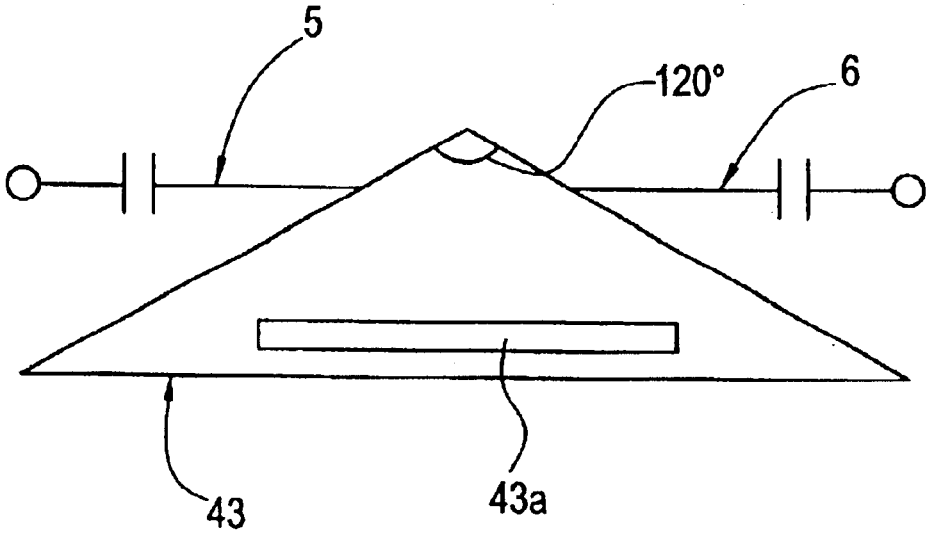
FIG. 34 is a schematic plan view of a dual mode band-pass filter according to a second modified example of the fifth preferred embodiment of the present invention.
Figure 35:
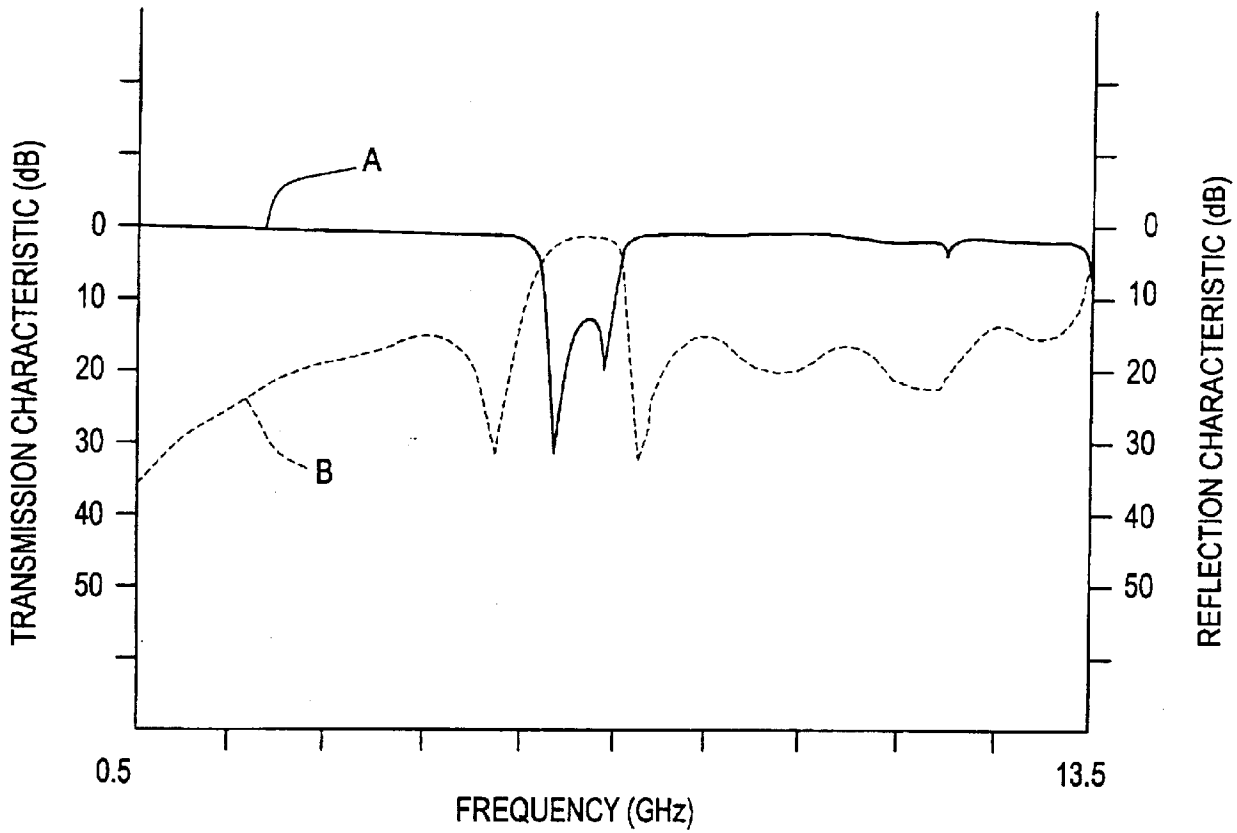
FIG. 35 is a graph showing the frequency characteristics of the dual mode band-pass filter of the second modified example of the fifth preferred embodiment of the present invention.

FIG. 34 is a schematic plan view showing a second modified example of the dual mode band-pass filter of the fifth preferred embodiment. FIG. 35 is a graph showing the frequency characteristics of the band-pass filter.

In the second modified example, the metallic film 43 having an isosceles triangular shape of which the vertical angle is approximately 120° and the base length is about 21 mm is formed. In the other respects, the band-pass filter is substantially the same as that of the fifth preferred embodiment. As seen in FIGS. 34 and 35, in the second modified example of the fifth preferred embodiment, the filter can be also operated as a dual mode band-pass filter.

According to preferred embodiments of the present invention, two resonance modes can be coupled to define dual mode band-pass filters by forming the above-described openings in the shape of different types of isosceles triangles or other shapes, adjusting the sizes of the openings, and connecting the input-output coupling circuits to different points on the triangles, as seen in the fifth preferred embodiment, and the first and second modified examples of the fifth preferred embodiment.

Figure 36:
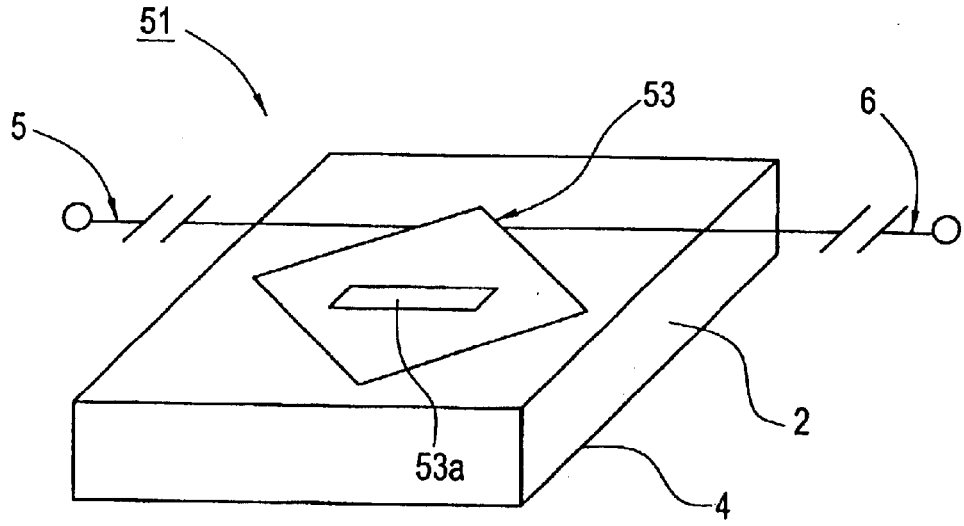
FIG. 36 is a perspective view of a dual mode band-pass filter according to a sixth preferred embodiment of the present invention.
Figure 37:
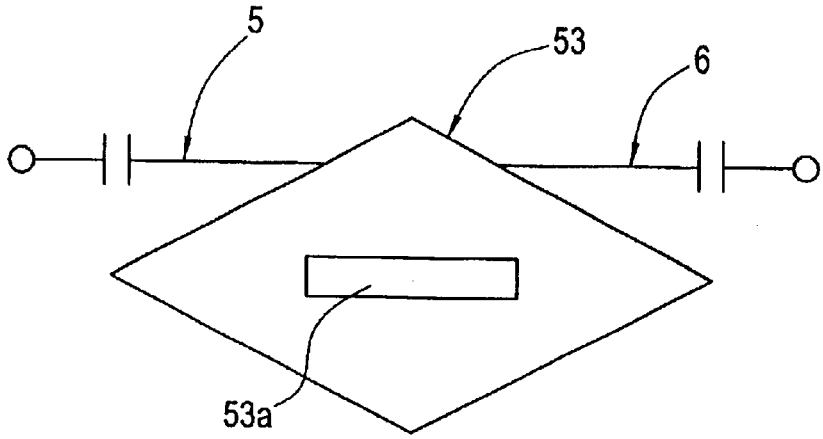
FIG. 37 is a schematic plan view showing the main portion of the dual mode band-pass filter of the sixth preferred embodiment of the present invention.
Figure 38:
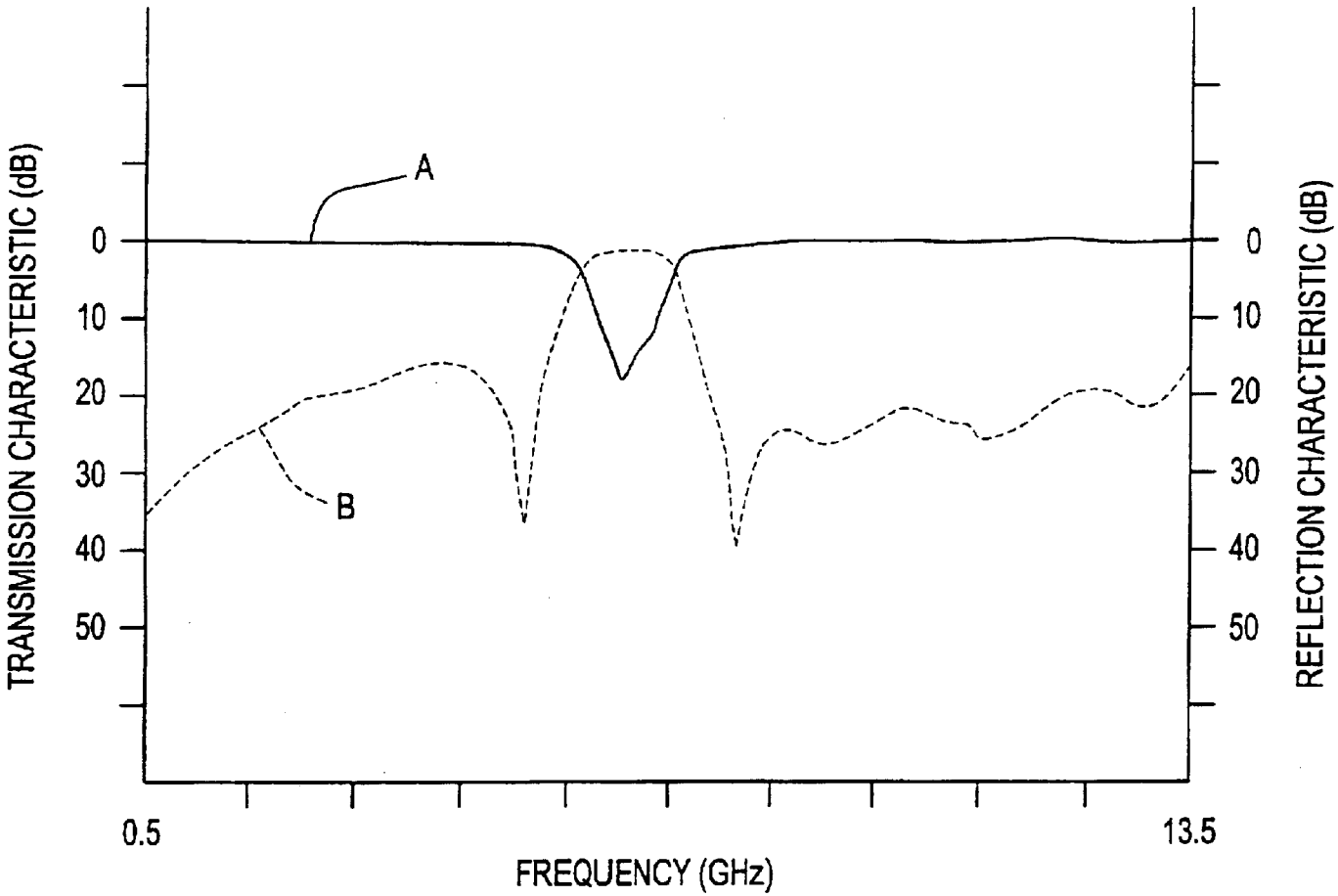
FIG. 38 is a graph showing the frequency characteristics of the dual mode band-pass filter of the sixth preferred embodiment of the present invention.

FIG. 36 is a perspective view showing the appearance of a dual mode band-pass filter 51 according to a sixth preferred embodiment of the present invention. FIG. 37 is a schematic plan view of the band-pass filter. FIG. 38 is a graph showing the frequency characteristics of the band-pass filter.

In a dual mode band-pass filter 51 of the sixth preferred embodiment, a metallic film 52 has a substantially rhomboid shape. In the other respects, the band-pass filter 1 is preferably substantially the same as that of the first preferred embodiment. A dielectric substrate and a ground electrode similar to those of the first preferred embodiment were used, and a metal film 53 having a substantially rhomboid shape with diagonal line lengths of about 21 mm and about 8 mm was formed. Furthermore, an opening 53*a* having a longer side length of about 14 mm and a shorter side length of about 0.2 mm was formed in the metallic film 53. The input-output coupling circuits 5 and 6 were connected to the two different sides of the metallic film 53. As seen in FIG. 38, in this dual mode band-pass filter, the two resonance modes can be also coupled to each other, and a characteristic suitable for the dual mode band-pass filter can be obtained, as a result of the above-described unique configuration.

In the dual mode band-pass filter of preferred embodiments of the present invention, the metallic film constituting a resonator may have a substantially rhomboid shape as seen in the sixth preferred embodiment.

Figure 39:
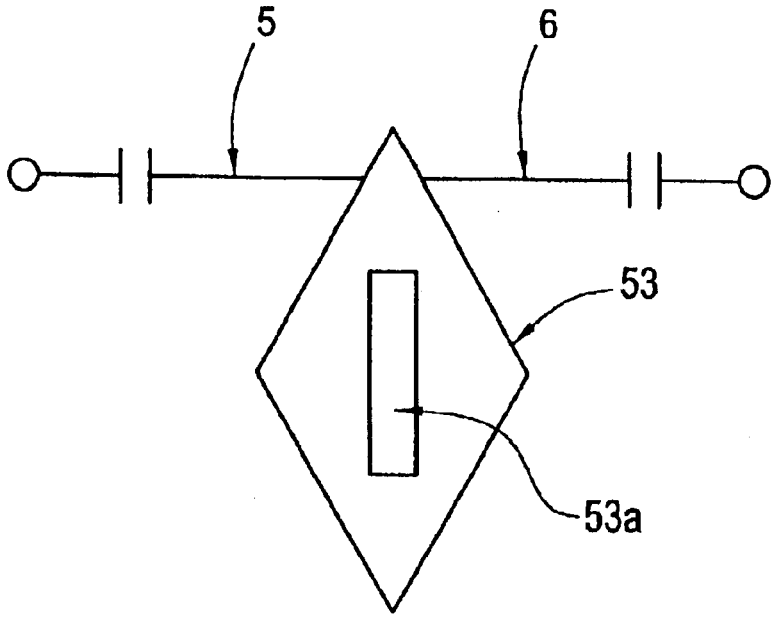
FIG. 39 is a schematic plan view of a dual mode band-pass filter according to a first modified example of the sixth preferred embodiment of the present invention.
Figure 40:
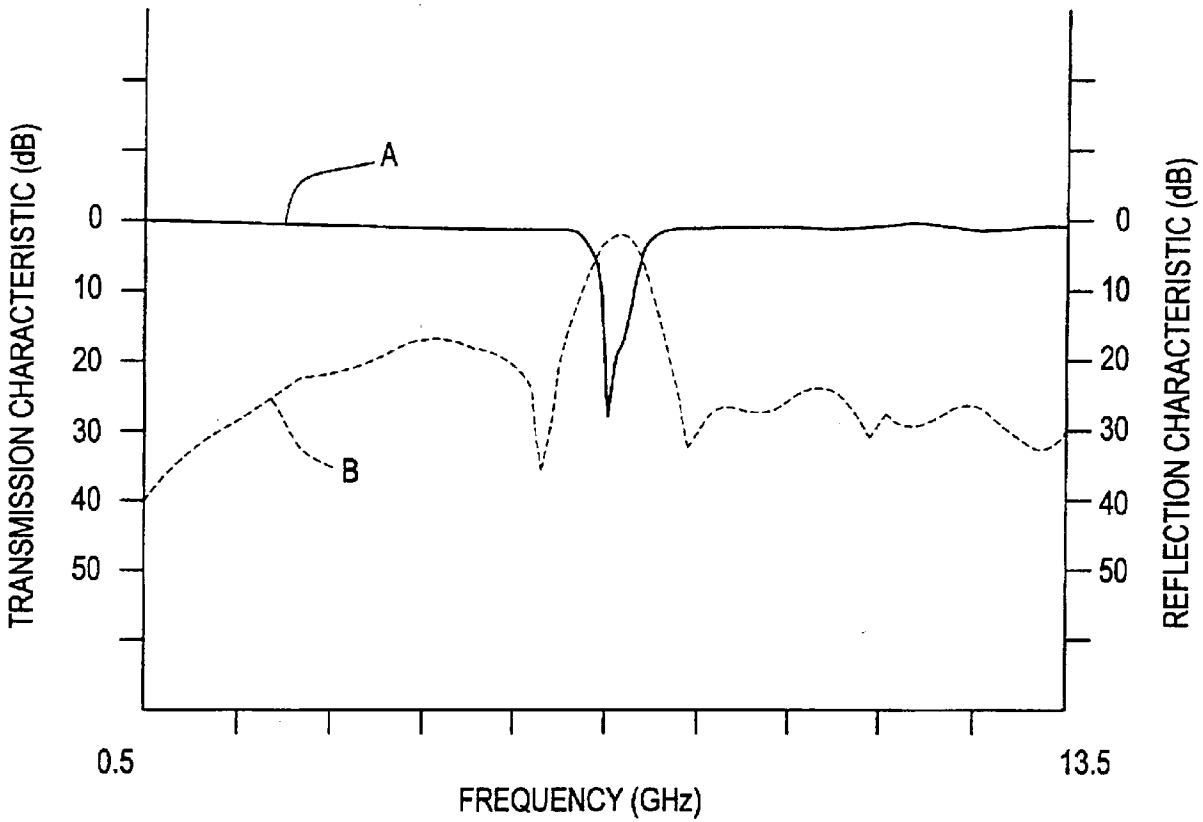
FIG. 40 is a graph showing the frequency characteristics of the dual mode band-pass filter of the first modified example of the sixth preferred embodiment of the present invention.

FIG. 39 is a schematic plan view showing a first modified example of the dual mode band-pass filter of the sixth preferred embodiment of the present invention, and FIG. 40 is a graph showing the frequency characteristics thereof. In the dual mode band-pass filter of the first modified example of the sixth preferred embodiment, the connection points of the input-output coupling circuits 5 and 6 are different from those in the sixth preferred embodiment. That is, the input-output coupling circuits 5 and 6 are connected to a metallic film 53 so as to be opposed to each other, in a direction that is substantially perpendicular to the longer diagonal line of the metallic film. In the other respects, the pass-band filter is preferably substantially the same as that of the sixth preferred embodiment.

As seen in FIGS. 39 and 40, in the dual mode band-pass filter of the first modified example of the sixth preferred embodiment, the two resonance modes can be coupled to each other. Furthermore, by comparing the frequency characteristics shown in FIGS. 39 and 40, it is seen that the bandwidth can be considerably varied by changing the connection points of the input-output coupling circuits 5 and 6.

Figure 41:
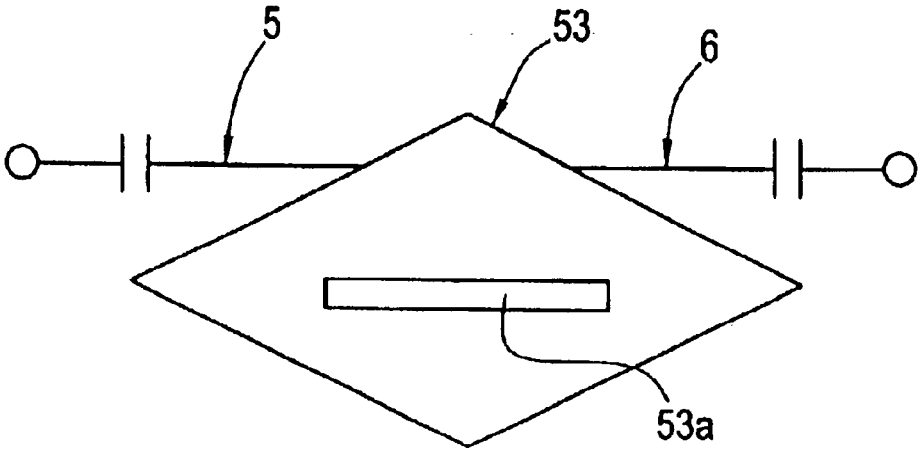
FIG. 41 is a schematic plan view of a dual mode band-pass filter according to a second modified example of the sixth preferred embodiment of the present invention.
Figure 42:
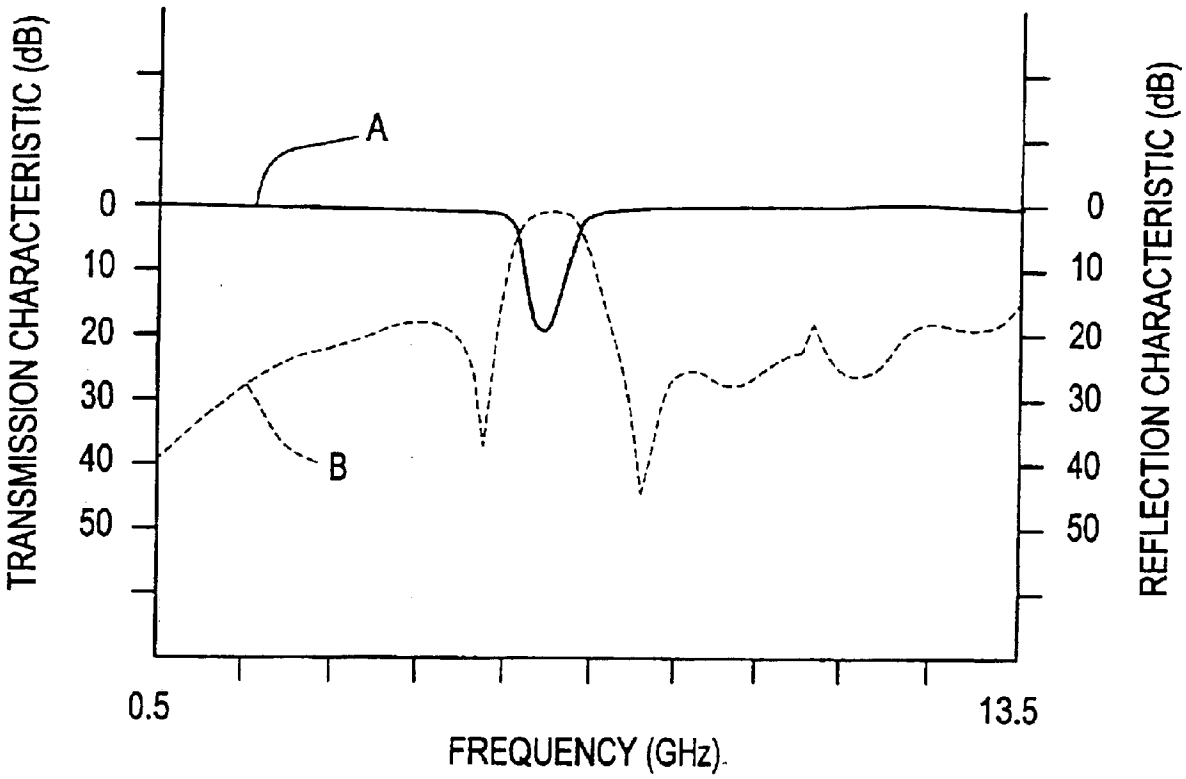
FIG. 42 is a graph showing the frequency characteristics of the dual mode band-pass filter of the second modified example of the sixth preferred embodiment of the present invention.

FIG. 41 is a schematic plan view of a second modified example of the dual mode band-pass filter of the sixth preferred embodiment, and FIG. 42 is a graph showing the frequency characteristic of the pass-band filter.

In the dual mode band-pass filter of the second modified example, the metallic film 53 preferably has a substantially rhomboid shape different from that in the sixth preferred embodiment. In the dual mode band-pass filter of the second modified example of the sixth preferred embodiment, the substantially rhomboid shape of the metallic film 53 is different from that in the sixth preferred embodiment. That is, the metallic film 53 is arranged to have a substantially rhomboid shape having diagonal line lengths of about 21 mm and about 12 mm. In the other respects, the band-pass filter is preferably substantially the same as that of the sixth preferred embodiment.

By comparing the characteristics shown in FIGS. 38 and 42, it is seen that the bandwidth can be changed by changing the short diagonal line of the rhombus.

When a resonator includes a metallic film having a substantially rhomboid shape, as described above, the bandwidth can be considerably varied by changing the rhomboid shape.

Figure 43:
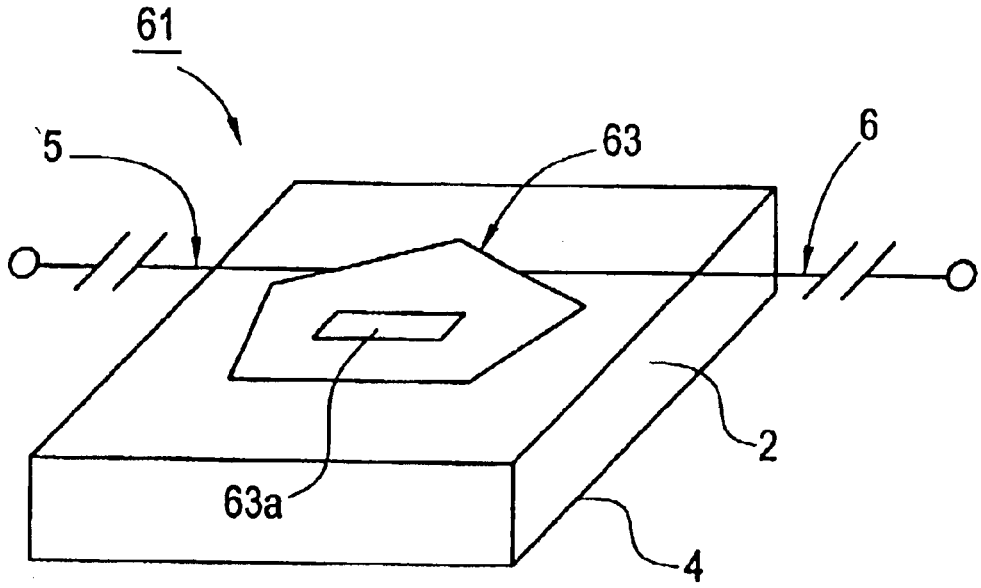
FIG. 43 is a perspective view of a dual mode band-pass filter according to a seventh preferred embodiment of the present invention.
Figure 44:
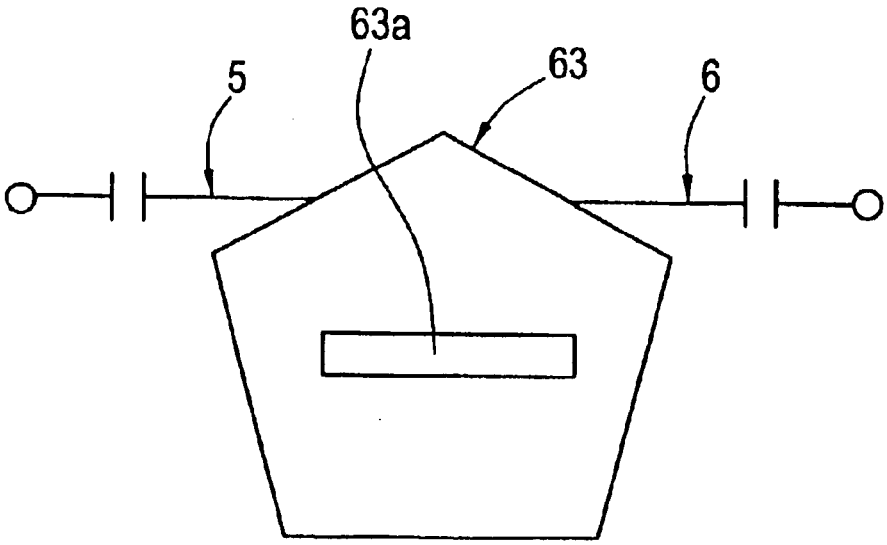
FIG. 44 is a schematic plan view showing the main portion of the dual mode band-pass filter of the seventh preferred embodiment of the present invention.

FIG. 43 is a perspective view showing the appearance of a dual mode band-pass filter according to a seventh preferred embodiment of the present invention, and FIG. 44 is a schematic plan view thereof.

Figure 45:
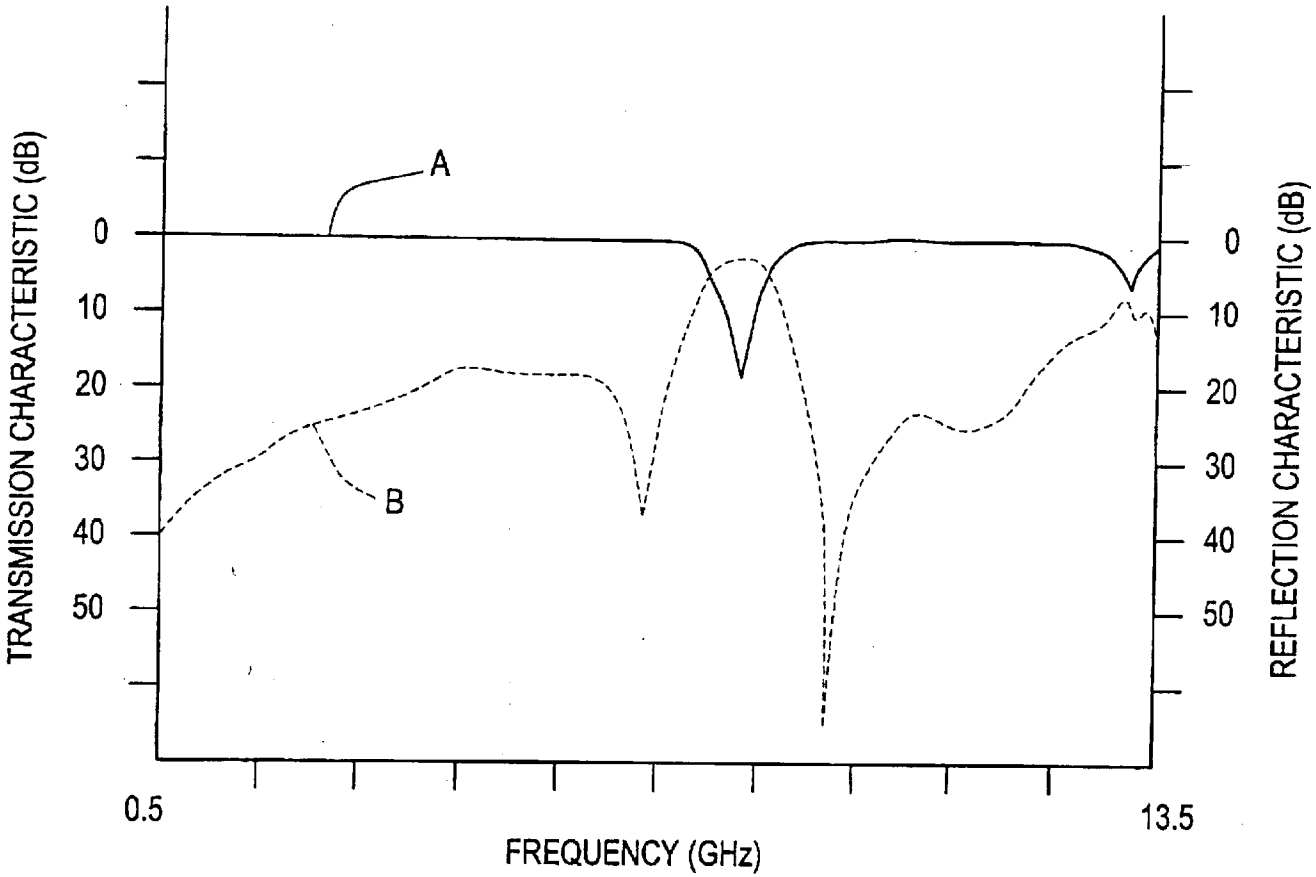
FIG. 45 illustrates the frequency characteristics of the dual mode band-pass filter of the seventh preferred embodiment of the present invention.

In the dual mode band-pass filter of the seventh preferred embodiment, a metallic film 63 constituting a resonator preferably has a substantially regular pentagonal shape. In the other respects, the configuration of the band-pass filter is preferably substantially the same as that in the first preferred embodiment. FIG. 45 shows the frequency characteristics of the dual mode band-pass filter formed in the same manner as the experimental example of the first preferred embodiment, except that the metallic film 63 has a substantially regular pentagon shape with a side-length of about 9.5 mm.

As seen in FIG. 45, in the case of the metallic film 63 having a substantially regular pentagonal shape, the two resonance modes can be also coupled by adjusting the size of an opening 63*a*, whereby the band-pass filter can be operated as a dual mode band-pass filter.

Figure 46:
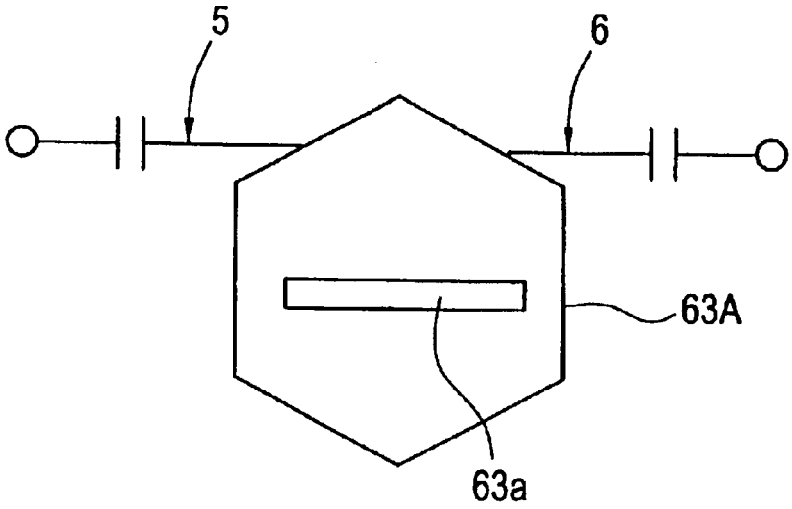
FIG. 46 is a schematic plan view of a dual mode band-pass filter according to a first modified example of the seventh preferred embodiment of the present invention.
Figure 48:
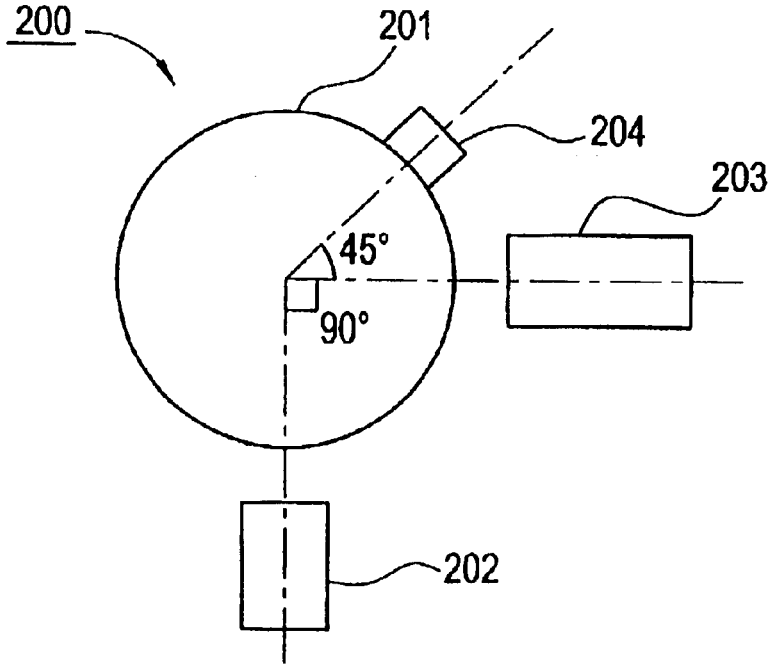
FIG. 48 PRIOR ART
FIG. 48 is a schematic plan view showing an example of a conventional dual mode band-pass filter.
Figure 47:
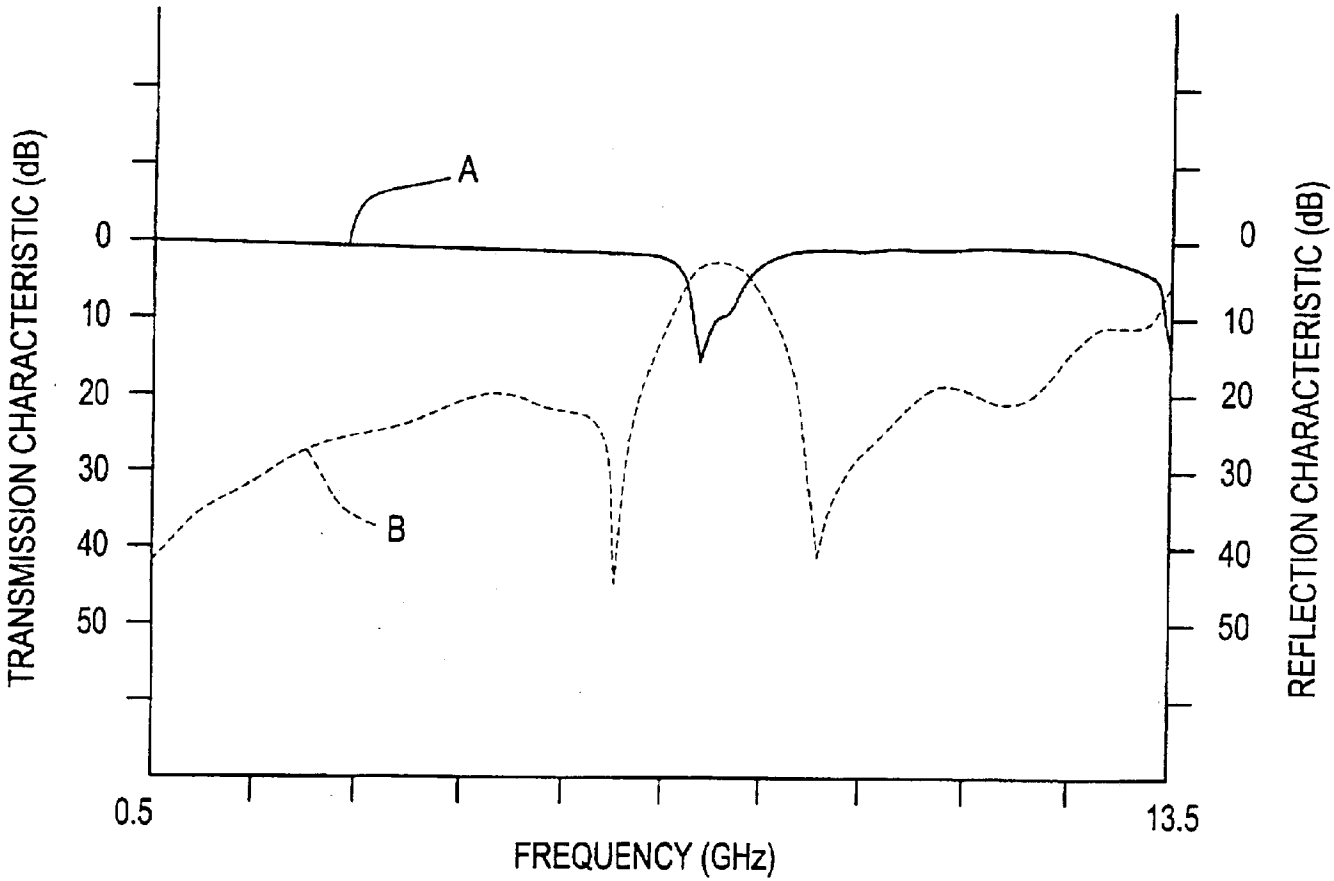
FIG. 47 is a graph showing the frequency characteristics of the dual mode band-pass filter of the first modified example of the seventh preferred embodiment of the present invention.
Figure 49:
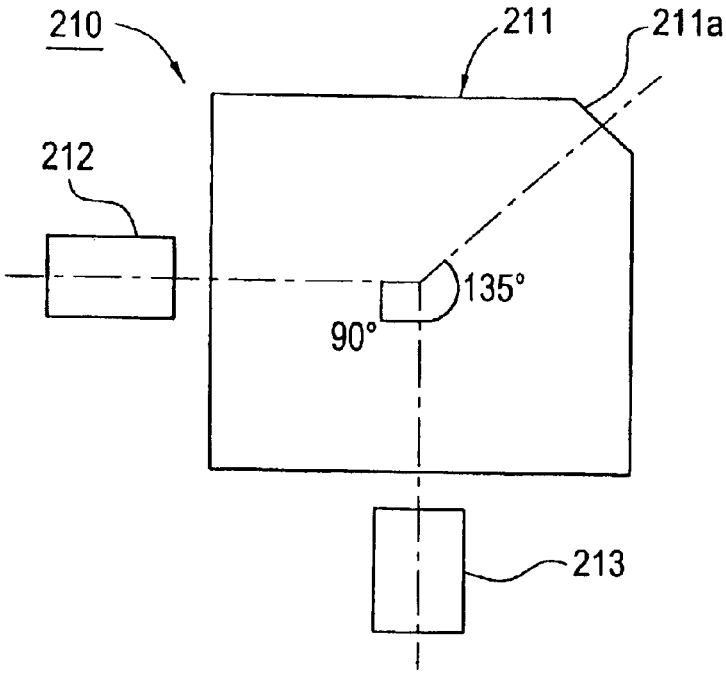
FIG. 49 PRIOR ART
FIG. 49 is a schematic plan view showing another example of the conventional dual mode band-pass filter.
Figure 50:
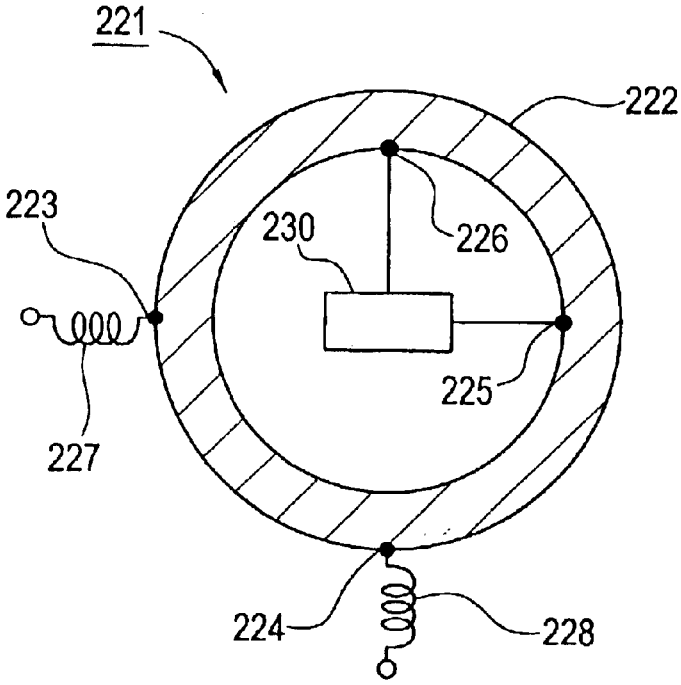
FIG. 50 PRIOR ART
FIG. 50 is a schematic plan view showing yet another example of the conventional dual mode band-pass filter.

FIG. 46 is a schematic plan view showing the major portion of a first modified example of the dual mode band-pass filter according to the seventh preferred embodiment of the present invention, and FIG. 47 illustrates the frequency characteristics thereof.

In the seventh preferred embodiment, the metallic film 63 preferably has a substantially regular pentagonal shape. In this preferred embodiment of the present invention, the shape of the metallic film is not limited to a substantially regular pentagon. The metallic film may have a substantially regular-hexagonal shape as presented in this modified example. Regarding the dual mode band-pass filter of the modified example shown in FIG. 46, the metallic film 63A was arranged to have a substantially regular hexagon shape with a side-length of about 7.5 mm, and the other sizes of the band-pass filter were preferably substantially the same as those in the seventh preferred embodiment. The frequency characteristic was measured. FIG. 47 shows the results.

In the case of the metallic film 63A with a substantially regular hexagonal shape, constituting a resonator, the two resonance modes can be coupled to each other, and the device can be operated as a dual mode band-pass filter, as seen in FIG. 47.

In the dual mode band-pass filter of preferred embodiments of the present invention, the metallic film for constituting a resonator is provided on the dielectric substrate, and the size of the opening is adjusted, whereby the two resonance modes can be coupled to each other without the positions of the connection points of the input-output coupling circuits having special limitations, and a characteristic suitable for a dual mode band-pass filter can be obtained. In contrast, a conventional dual mode band-pass filter is limited in the shape of the metallic film for constituting a resonator and the positions of the connection points of the input-output coupling circuits are limited. On the other hand, the dual mode band-pass filter of preferred embodiments of the present invention eliminates such limitations. Thus, the design flexibility of preferred embodiments of the present invention is greatly increased.

Moreover, the band-width in preferred embodiments of the present invention can be significantly adjusted by changing the size of the metallic film, the size of the opening, and the positions of the connection points of the input-output coupling circuits. Thus, a dual mode band-pass filter having a desired band-width can be easily provided.

Preferably, according to preferred embodiments of the present invention, the opening preferably has a plan shape so as to contain a longer dimension and a shorter dimension. In this case, the resonance current that is generated in a direction that is substantially perpendicular to the longer dimension is interrupted by the opening. The resonance frequency of the resonance propagated substantially perpendicularly to the longer dimension of the opening can be easily changed. Thereby, the two resonance modes can be securely coupled to each other.

In the dual mode band-pass filter of preferred embodiments of the present invention, the opening and the plan shape of the metallic film have no limitations, respectively. Dual mode band-pass filters having different shapes of openings and metallic films can be provided. For example, as the opening, a rectangle, an ellipse, a configuration including a rectangle or ellipse having a bent portion thereof elongating in a direction intersecting the longer dimension, or a cross shape can be used. Similarly, for the metallic film, a rectangle, a rhombus, a regular polygon, a circle, an ellipse, or an optional shape of which the periphery has an irregular shape.

In other preferred embodiments of the present invention, preferably, a plurality of openings may be formed. The band-width can be adjusted by changing the number of the openings.

In the dual mode band-pass filter of preferred embodiments of the present invention, the metallic film and the ground electrode may be disposed either on the surface of the dielectric substrate or inside thereof. In the case of the configuration in which the metallic film is provided on the first main surface of the dielectric substrate, and the ground electrode is disposed on the second main surface thereof, the dual mode band-pass filter of the present invention can be simply formed by forming conductive films on both surfaces of a dielectric substrate, respectively.

Furthermore, in the case of the tri-plate structure, radiation from the metallic film can be prevented. Thus, the loss of the band-pass filter can be even more reduced.

While preferred embodiments of the invention have been disclosed, various modes of carrying out the principles disclosed herein are contemplated as being within the scope of the following claims. Therefore, it is understood that the scope of the invention is not to be limited except as otherwise set forth in the claims.

What is claimed is:

1. A dual mode band-pass filter comprising:

a dielectric substrate having first and second main surfaces;

a metallic film having an opening and disposed on the first main surface of the dielectric substrate or inside of the dielectric substrate;

at least one ground electrode disposed on the second main surface of the dielectric substrate or inside of the dielectric substrate, so as to be opposed to the metallic film through a dielectric layer; and a pair of input-output coupling circuits connected to different portions of the metallic film; wherein the shape of the metallic film is substantially rectangular and the connection points of the input-output coupling circuits are located on one side of said substantially rectangular metallic film; and the connection points belong to a common resonance mode.

2. A dual mode band-pass filter comprising:

a dielectric substrate having first and second main surfaces;

a metallic film having an opening and disposed on the first main surface of the dielectric substrate or inside of the dielectric substrate;

a least one ground electrode disposed on the second main surface of the dielectric substrate or inside of the dielectric substrate, so as to be opposed to the metallic film through a dielectric layer; and a pair of input-output coupling circuits connected to different portions of the metallic film; wherein the shape of the metallic film is substantially rectangular and the connection points of the input-output coupling circuits are located on one side of said substantially rectangular metallic film; and the shape of the metallic film, the positions of the connection points of the input-output coupling circuits, and the shape of the opening on the metallic film are selected such that a first resonance mode propagated substantially parallel to an imaginary straight line passing through the connection points of the input-output coupling circuits and a second resonance mode propagated substantially perpendicular to the imaginary straight line are coupled to each other.

3. The dual mode band-pass filter according the claim 2, wherein the first and second resonance modes have different resonance frequencies.

4. The dual mode band-pass filter according to claim 3, wherein the substantially rectangular metallic film includes two shorter sides and two longer sides, and the connection points are located on one of said two longer sides of the metallic film.

* * * * *